US012523042B1

(12) United States Patent
Lair

(10) Patent No.: US 12,523,042 B1
(45) Date of Patent: Jan. 13, 2026

(54) ADAPTIVE SUPPORTING STRUCTURE OF STAIRWAY FOR ACCESSING SPACE ABOVE OR BELOW AN ELEVATED STRUCTURE

(71) Applicant: Jean-Pierre Lair, Georgetown, TX (US)

(72) Inventor: Jean-Pierre Lair, Georgetown, TX (US)

( * ) Notice: Subject to any disclaimer, the term of this patent is extended or adjusted under 35 U.S.C. 154(b) by 0 days.

(21) Appl. No.: 19/073,717

(22) Filed: Mar. 7, 2025

(51) Int. Cl.
*E04F 11/06* (2006.01)

(52) U.S. Cl.
CPC ..... *E04F 11/068* (2013.01)

(58) Field of Classification Search
CPC ..... E04F 11/068; E04F 11/066; E04F 11/064; E04F 11/062; E04F 11/06; E04F 11/04; E06C 1/12
USPC ..... 182/81, 80, 79, 78, 77
See application file for complete search history.

(56) References Cited

U.S. PATENT DOCUMENTS 1,594,655 A * 8/1926 Bessler ..... E04F 11/04 182/80
1,811,707 A * 6/1931 Bessler ..... E04F 11/04 182/80
1,867,904 A * 7/1932 Bessler ..... E04F 11/068 182/78
1,870,603 A * 8/1932 Cicilioni ..... E04F 11/04 182/80
1,936,929 A * 11/1933 Bessler ..... E04F 11/04 182/80
2,220,155 A * 11/1940 Jachim ..... E06C 9/06 182/1
2,852,176 A * 9/1958 Harmon ..... E04F 11/064 182/98
3,331,466 A * 7/1967 Webb, Sr. ..... E04F 11/068 182/98
3,901,353 A * 8/1975 Skolnik ..... E04F 11/064 182/78
3,985,202 A * 10/1976 Harmon ..... E04F 11/04 182/79
7,841,448 B2 * 11/2010 Lair ..... E06C 1/12 182/78
8,028,804 B2 * 10/2011 Lair ..... E06C 1/12 182/78
12,173,511 B1 * 12/2024 Lair ..... E06C 1/12
(Continued)

*Primary Examiner* — Colleen M Chavchavadze
*Assistant Examiner* — Shiref M Mekhaeil
(74) *Attorney, Agent, or Firm* — Pillsbury Winthrop Shaw Pittman LLP

(57) ABSTRACT

An adaptive supporting structure of a stairway for accessing space above or below an elevated structure. The adaptive structure includes a forward structural and a rear structural module. The forward module holds the system that limits the opening angle of the module and is hinged on the supporting structure that surrounds the Rough Opening in the ceiling. The spacing between the rear structural module and the forward structural module can be adjusted to whatever length of the Rough Opening in the ceiling. The rear structural module holds all the components of the automated ladder apparatus. The fixed section of the automated ladder is mechanically bridging both structural modules while the bottom part of the structural modules supports a cover that cooperates with a fixed fairing mechanically attached to a portion of the framing that surrounds the Rough Opening in the ceiling.

20 Claims, 14 Drawing Sheets

(56) References Cited

U.S. PATENT DOCUMENTS

| | | | | |
|---|---|---|---|---|
| 2007/0181364 | A1* | 8/2007 | Lair | E04F 11/064 182/77 |
| 2008/0060874 | A1* | 3/2008 | Lair | E04F 11/064 182/77 |
| 2009/0288351 | A1* | 11/2009 | Burke | E04F 11/064 52/183 |
| 2016/0333592 | A1* | 11/2016 | Alexander | E04F 11/064 |
| 2018/0320444 | A1* | 11/2018 | Beard | E06C 9/08 |

* cited by examiner

ADAPTIVE SUPPORTING STRUCTURE OF STAIRWAY FOR ACCESSING SPACE ABOVE OR BELOW AN ELEVATED STRUCTURE

FIELD

The present invention relates to an adaptive supporting structure of an automatic extendable and retractable stairway that is hinged on a framing structure that surrounds an opening to provide access to a space above or below an elevated structure.

BACKGROUND

Ladders for attic access are widely used by the people in their private homes. Attics access is usually provided above the garages and/or living quarters of private homes. The most common attic access consists of an access panel, pivotally mounted on a structure that is attached to an opening in the ceiling. The opening in the ceiling, often referred as Rough Opening (RO) may have various sizes in both dimensions, length and in width. Consequently, the supporting structure of the stairway mounted on the pivoting access panel need to be designed and manufactured for each of the various sizes of the RO.

U.S. Pat. Nos. 7,841,448 and 8,028,804 describe an automatic ladder for attic access that can be retracted and extended by an electric motor. The motor is not mounted on the pivoting access panel and the length and width of the supporting structure of the ladder sliding sections has to be sized for each RO dimensions. Consequently, this greatly increases the manufacturing cost of the complete ladder.

U.S. Pat. No. 12,173,511 describes an automatic ladder for attic access that can be retracted and extended by an electric motor. While the motor is mounted on the pivoting access panel, the length and width of the supporting structure of the ladder sliding sections have to be sized for each RO dimensions. Consequently, this greatly increases the manufacturing cost of the complete ladder as a specific supporting structure for the ladder sliding sections and for the motorized system has to be built for each RO dimensions.

It would consequently be of great benefit to provide a single supporting structure of the ladder motorized system and of the ladder sliding sections that can be used for all the various Rough Opening dimensions that are commonly used in residential construction.

SUMMARY

An aspect of the present invention overcomes the drawbacks of the prior art by providing an adaptive supporting structure of the stairway sliding sections and motorized system for any length of the rough opening of the ceiling. In an aspect of the present disclosure, the adaptive structure of the stairway is adjustable in length and hinged on a framing structure that surrounds an opening to provide access to a space above or below an elevated structure. More particularly, in an embodiment of the disclosure, the adaptive supporting structure is composed of two separate structural modules for support of the stairway fixed section on which are mounted the sliding sections of the stairway. The two structural modules are composed of a forward structural module and a rear structural module.

In an aspect of the disclosure, there is provided a stairway system for accessing a space above or below an elevated structure, the stairway system comprising:

an adaptive supporting structure including

- a forward structural module configured to be pivotally mounted within an opening of the elevated structure, the forward structural module including
  - a first end configured to be pivotally connected to a support structure via a pivot axis,
  - a second end extending away from the pivot axis,
  - a mechanism attached to the elevated structure and configured to control a pivoting angle of the forward structural module;
- a rear structural module positioned rearward of the forward structural module and mechanically connected thereto;
- at least two cantilever arms extending from the second end of the forward structural module, at least one of the rear and forward structural modules being adjustably mounted to the cantilever arms at a selectable distance from the other one of the at least one of the rear and forward structural modules;
- a fixed stairway section mounted to and bridging the forward structural module and rear structural module, the fixed stairway section having an upper surface for supporting at least one sliding stairway section;
- a motorized system mounted on the rear structural module and operatively connected to the at least one sliding stairway section, the motorized system being configured to control the extension and retraction of the at least one sliding stairway section;
- a cover attached to an underside of the forward structural module and rear structural module;
- wherein at least one of the rear and forward structural modules are secured to the cantilever arms at a selected one of a plurality of preset positions, allowing the stairway system to accommodate various Rough Opening dimensions;
- and wherein the forward structural module and rear structural module pivot in unison about the pivot axis during deployment and retraction of the stairway system.

In an embodiment of the disclosure, the forward structural module is hinged on a framing structure that surrounds an opening in a ceiling to provide access to a space above or below an elevated structure. The forward structural module provides partial support of the stairway fixed section on which are installed the sliding sections, partial support of the cover that closes the opening in the ceiling when the stairway is retracted and full support of the mechanism that controls the opening angle of the forward structural module. The forward structural module is configured to support the rear structural module.

In an embodiment of the disclosure, the rear structural module is adapted to be mechanically attached to the forward structural module. The rear structural module provides partial support to the stairway fixed section on which the sliding sections are installed, partial support of the panel that closes the opening in the ceiling when the stairway is retracted and full support of the complete motorized system that controls the operation of the stairway.

In an embodiment of the disclosure, the framing structure supports the forward fairing that cooperates with the panel to finish closing the opening in the ceiling when the stairway is retracted;

In an embodiment of the disclosure, the forward structural module is fitted with cantilever arms for support of the rear structural module.

In an embodiment of the disclosure, the cantilever arms are configured to support the rear structural module at different longitudinal positions.

In an embodiment of the disclosure, the rear structural module is fixedly attached to the cantilever arms in the most rearward position.

In an embodiment of the disclosure, the rear structural module is fixedly attached to the cantilever arms in the most forward position.

In an embodiment of the disclosure, the rear structural module is fixedly attached to the cantilever arms at any positions in between the most rearward position and the most forward position.

In an embodiment of the disclosure, the mechanism includes balancing arms are connected to one or more rods supported by bearings mounted on walls of the forward structural module.

In an embodiment of the disclosure, the pivoting angle of the forward structural module is defined by a structural pin interacting with an angular limit fitting mounted on a wall of the forward structural module to restrict opening of the forward structural module to the maximum opening angle.

In an embodiment of the disclosure, the structural pin is mounted on a rod mounted on the forward structural module, the structural pin adapted to rotate in unison with the rod so as to interact with said angular limit fitting.

In an embodiment of the disclosure, the cantilever arms include preset holes for securing the rear structural module at a desired position using fasteners.

In an embodiment of the disclosure, the cover is adapted to cooperate with a fixed fairing mounted on the elevated structure to at least partially close the opening when the stairway system is in a retracted position.

In an embodiment of the disclosure, the forward edge of the cover is designed to fit within the fixed fairing to create a sealed closure when the stairway system is in the retracted position.

In an embodiment of the disclosure, the fixed stairway section is fastened to the forward structural module and the rear structural module via a plurality of fasteners.

In an embodiment of the disclosure, the motorized system includes a gearmotor, shafts, and at least one reel configured to wind and unwind a cable system that controls the movement of the at least one sliding stairway section.

In an embodiment of the disclosure, the motorized system is configured to provide controlled extension and retraction of the at least one sliding stairway section at a speed defined by the gearmotor ratio.

In an embodiment of the disclosure, the rear structural module includes a platform that serves as a mounting base for the motorized system.

In an embodiment of the disclosure, the at least one sliding stairway section is configured to extend outward in a telescoping manner from the fixed stairway section when the stairway system is deployed.

In an embodiment of the disclosure, the motorized system is configured to operate via a wired control switch, a remote wireless control.

In an embodiment of the disclosure, the pivot axis of the forward structural module is positioned near a front portion of the rough opening, enabling the stairway system to pivot outward smoothly during deployment, and the motorized system is mounted near a rear portion of the rear structural module such that the pivot axis and the motorized system are arranged on opposite ends of the adaptive supporting structure.

In another aspect of the disclosure, there is provided an adaptive supporting structure of a stairway system for accessing a space above or below an elevated structure, the adaptive supporting structure comprising:

- a forward structural module configured to be pivotally mounted within an opening of the elevated structure, the forward structural module including
  - a first end configured to be pivotally connected to a support structure of the elevated structure via a pivot axis,
  - a second end extending away from the pivot axis,
  - a mechanism configured to be attached to the elevated structure and configured to control a pivoting angle of the forward structural module;
  - a rear structural module positioned rearward of the forward structural module and mechanically connected thereto;
  - at least two cantilever arms extending from the second end of the forward structural module, at least one of the rear and forward structural modules being adjustably mounted to the cantilever arms at a selectable distance from the other one of the at least one of the rear and forward structural modules;
- a fixed stairway section mounted to and bridging the forward structural module and rear structural module, the fixed stairway section having an upper surface for supporting at least one sliding stairway section;
- a motorized system mounted on the rear structural module and operatively connected to the at least one sliding stairway section, the motorized system being configured to control the extension and retraction of the at least one sliding stairway section;
- a cover attached to an underside of the forward structural module and rear structural module;
- wherein at least one of the rear and forward structural modules are secured to the cantilever arms at a selected one of a plurality of preset positions, allowing the stairway system to accommodate various Rough Opening dimensions;
- and wherein the forward structural module and rear structural module are configured to pivot in unison about the pivot axis during deployment and retraction of the stairway system.

In an embodiment of the disclosure, there is provided an adaptive structural support of an automated ladder apparatus including a plurality of ladder sliding sections to provide access to a space above or below an elevated structure, the adaptive structural support comprising:

- A forward structural module that is pivotable about a pivot axis and that partially supports the stairway fixed section on which the sliding sections are installed and partially supports a cover for an opening in said elevated structure;
- The forward structural module being pivotable about a pivot axis and fully supporting the mechanism that controls the opening angle of the forward structural module;
- The forward structural module partially supporting a cover and cooperating with a fixed fairing for the closed or opened position of the forward structural module;
- A rear structural module that partially supports the stairway fixed section on which the sliding sections are installed, and partially supports a cover for an opening in said elevated structure and that fully supports, in its aft end, the motorized system of the automated ladder apparatus;

The forward structural module being fitted with cantilever arms for support of the rear structural module;

The rear structural module being attachable to the cantilever arms in the most rearward position, the most forward position or any positions in between;

In an embodiment of the disclosure, the motorized system is mounted on and near the aft end of the rear module.

In another aspect of the disclosure, there is provided a method of adapting the length of the supporting structure of the automated ladder for accommodating the various length of rough openings that are commonly used in residential constructions. The simple method consists of bolting the rear structural module at the preset holes positions on the cantilever arms that are fixedly attached to the forward structural module.

Various aspects of the disclosure, in accordance with exemplary embodiments, together with further objects and benefits thereof, is more particularly described in the following detailed description taken in conjunction with the accompanying drawings.

DETAILED DESCRIPTION

Figure 1:
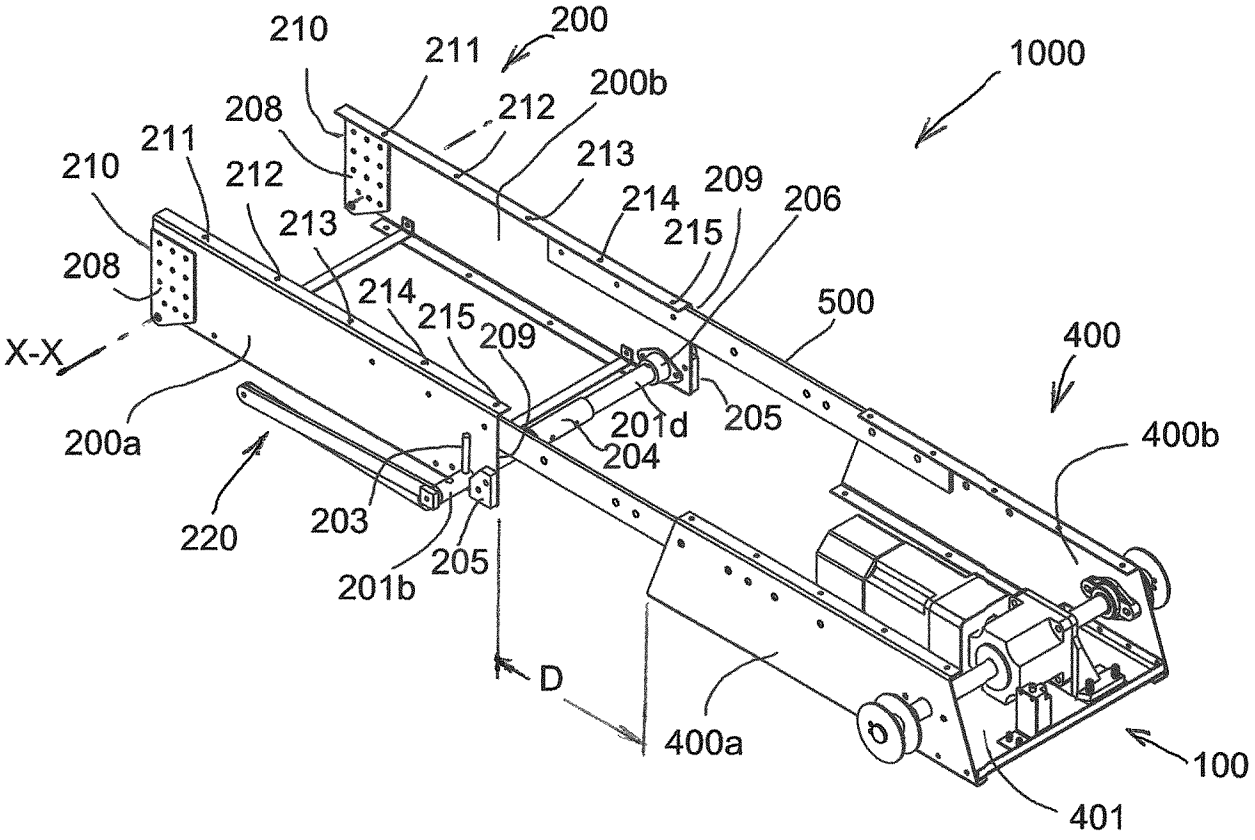
FIG. 1 is a perspective view, shown in its closed position and in its longest adjustment, of the adaptive supporting structure according to an embodiment of the disclosure.

In the following detailed description, reference is made to the accompanying drawings, which form a part hereof and are shown to illustrate specific embodiments in which the invention may be practiced. These embodiments are described in sufficient detail to enable those skilled in the art to practice the invention. It is understood that other embodiments may be utilized without departing from the spirit or scope of the invention. To avoid details not necessary to enable those skilled in the art to practice the invention, the description may omit certain information known to those skilled in the art. The following detailed description is, therefore, not to be taken in a limiting sense, and the scope of the present invention is defined only by the appended claims.

FIGS. 1, 2, 3, 9*a* and 9*b* show an embodiment of the adaptive supporting structure 1000 of the stairway or stairway system 1001 for various Rough Openings dimensions. The forward and rear structural modules of the adaptive structure of the invention are designed to adapt to different dimensions of an opening in a ceiling for support of a plurality of retractable and extendable sliding sections of a stairway that provide access to a space above or below an elevated structure. The stairway or stairway system 1001 (FIGS. 9*a*, 9*b*) (well documented in U.S. Pat. No. 12,173,511) includes a supporting frame 10 (FIG. 8) on which is hinged the forward structural module of the adaptive structure. The adaptive structure 1000 is composed of two structural modules, i.e., a forward structural module 200 that is hinged on a frame 12*c* section of the supporting frame 10 (FIG. 8), and a rear structural module 400 mechanically attached to cantilever arms 500 that are mechanically attached to the forward structural module 200. While the forward structural module 200 holds the mechanism 201*a*, 201*b*, 201*c*, 201*d*, 204, 205 (FIG. 4*a*) that controls the opening angle of the forward module, the rear structural module holds the motorized system 100 of the stairway (FIGS. 1, 2, 3, 7, 8, 8*a*).

Referring now to FIG. 1, this figure provides a perspective view of the adaptive supporting structure 1000 of an automatic extendable (FIG. 9*a*) and retractable (FIG. 9*b*) stairway system 1001. This adaptive supporting structure 1000 is designed to enable access to elevated spaces, such as attics or storage areas, while accommodating various dimensions of rough openings (RO) in ceilings. The design emphasizes adaptability, allowing its components to be configured for different installation requirements.

In FIG. 1, certain components are intentionally omitted to facilitate a clearer understanding of the adaptive supporting structure 1000 and its core elements. Specifically, the cover 20, the fixed ladder section 600, and the one or more sliding ladder sections 700, 800 (shown in FIGS. 9*a*-*b*) are not shown. Additionally, various elements that enable the operation of the stairway system, such as associated components of the motorized system 100 like cables and reels, are excluded. This omission simplifies the depiction and focuses attention on the structural relationship between the forward structural module 200, the rear structural module 400, and their connection through the cantilever arms 500. By presenting the structure in this manner, the figure provides a clear and uncluttered view of the framework, facilitating a better understanding of how the adaptive supporting structure 1000 is designed and functions without distraction from other operational or aesthetic elements.

Figure 9A:
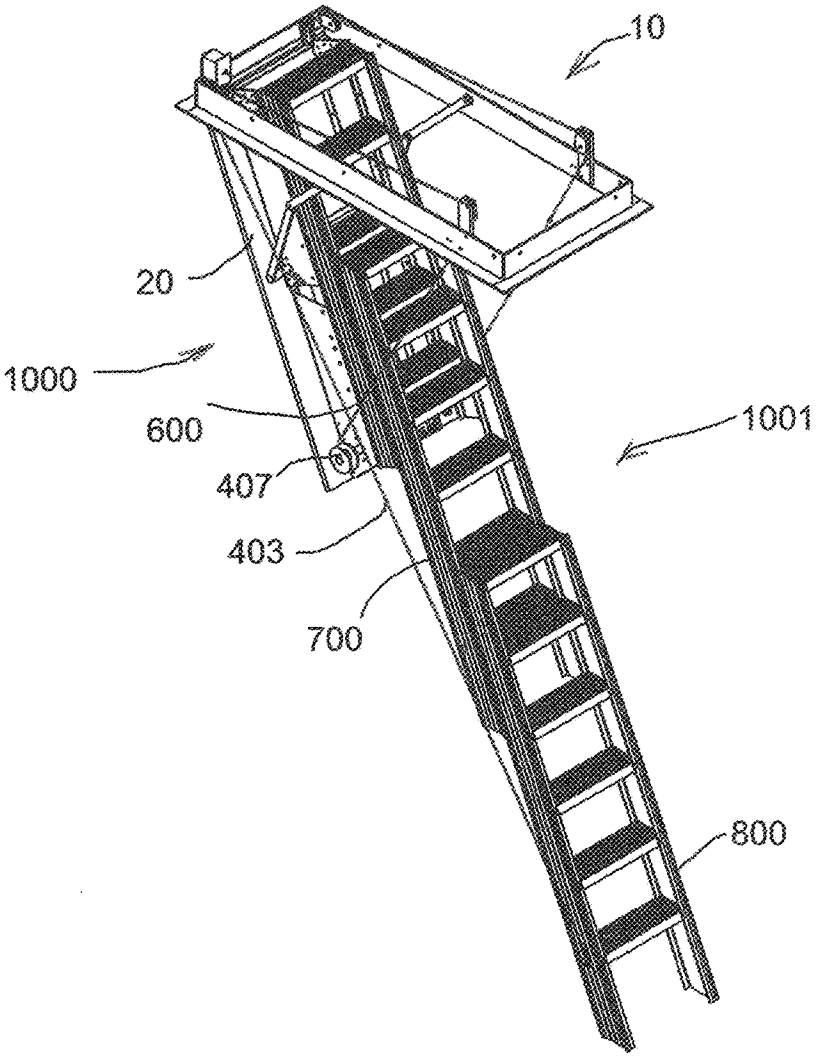
FIG. 9*a* shows an embodiment of the stairway system in the extended configuration according to an embodiment of the disclosure.
Figure 9B:
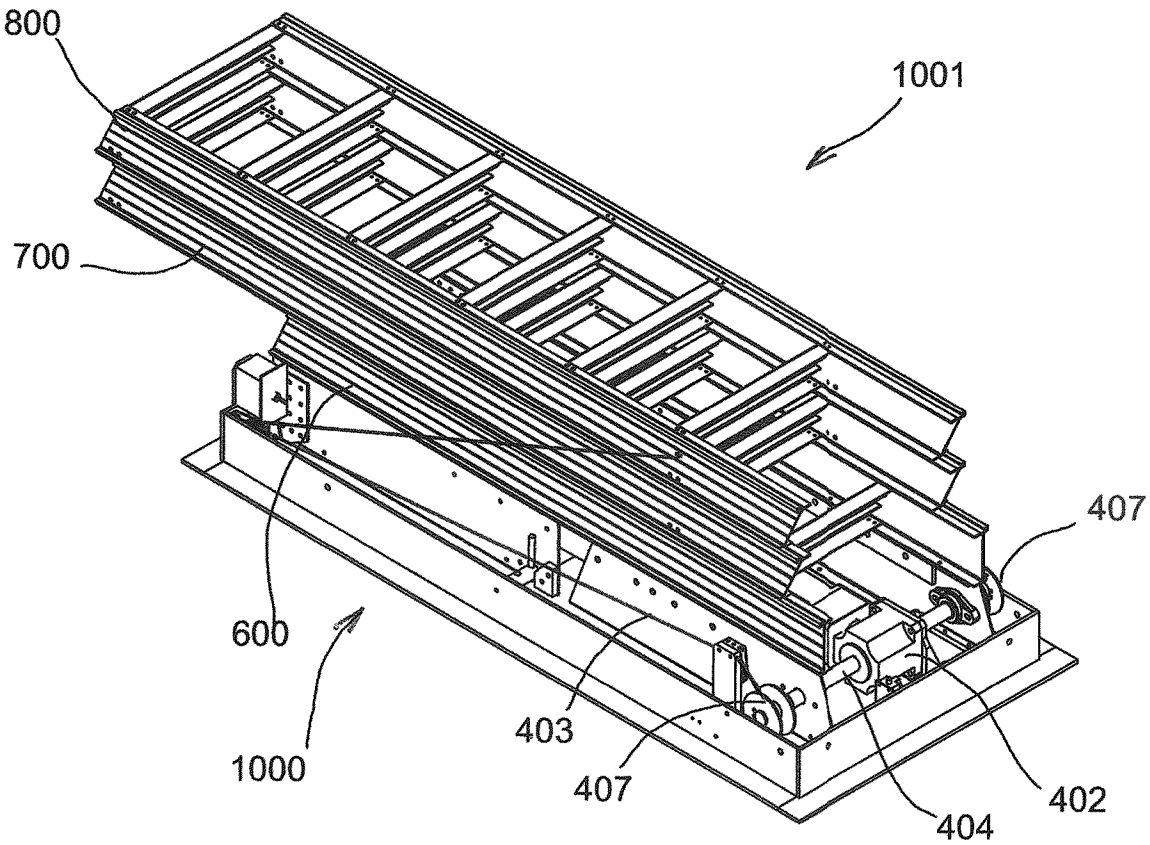
FIG. 9*b* shows an embodiment of the stairway in the retracted configuration according to an embodiment of the disclosure.

As shown in FIG. 1, the adaptive supporting structure 1000 comprises a forward supporting structure 200 and a rear structural module 400. The forward structural module 200 serves as the primary hinged component of the stairway system 1001. The forward structural module 200 pivots about a defined pivot axis X-X and includes two parallel frames 200*a*, 200*b* with, for example, a C-shaped cross-section for enhanced structural support. At its forward ends 210 fittings 208 connect the forward structural module 200 to clevis-type connectors on the surrounding framing structure 10 enabling pivotal motion. While this forward structural module 200 partially supports the fixed stairway section 600 and partially supports the rear cover 20 that partially closes the ceiling opening when the stairway system 1001 is retracted, the fixed section 600 supports the one or more movable stairway sections (FIG. 9*a* shows two movable sliding sections 700, 800 in the extended position supported by the fixed section 600 and FIG. 9*b* shows these sliding sections retracted on the fixed section 600 supported by the adaptive supporting structure 1000).

The rear structural module 400 is positioned behind the forward structural module 200 and comprises two structural beams 400*a*, 400*b* with similar, e.g., C-shaped cross-sections. It provides additional support to the fixed stairway section 600 and houses the motorized system 100 responsible for ladder extension and retraction, as will be explained hereinafter. The rear structural module 400 connects to the forward structural module 200 using cantilever arms 500 that extend beyond the rear end 209 of the forward structural module 200. These cantilever arms 500 include preset holes 501, 502, 503, 504, 505 (see FIG. 4) allowing the rear structural module 400 to be positioned at various distances from the forward structural module 200, enabling adaptability to different rough opening (RO) lengths. In one or more embodiments, at least one of the rear and forward structural modules is adjustably mounted to the cantilever arms at a selectable distance from the other one of the at least one of the rear and forward structural modules. In an embodiment, the rear structural module is adjustably mounted to the cantilever arms at a selectable distance from the forward structural module. In another embodiment, the forward structural module is adjustably mounted to the cantilever arms at a selectable distance from the rear structural module. In another embodiment, it will be appreciated that both the forward and rear structural modules could be adjustably mounted to the cantilever arms to vary the distance D. In an embodiment, at least one of the rear and forward structural modules are secured to the cantilever arms at a selected one of a plurality of preset positions, allowing the stairway system to accommodate various Rough Opening dimensions. In an embodiment, the rear structural module are secured to the cantilever arms at a selected one of a plurality of preset positions, allowing the stairway system to accommodate various Rough Opening dimensions.

In one or more embodiments of the disclosure, the forward structural module 200, rear structural module 400, and the cantilever arms 500 can be constructed from a variety of durable materials to ensure structural integrity and adaptability. Examples include sheet metal aluminum or steel, which are preferred due to their high strength-to-weight ratio, corrosion resistance, and case of fabrication. Alternatively, the modules and arms could be made from casted materials, such as cast aluminum or iron, providing excellent rigidity and the ability to form complex shapes with precision. For lightweight applications, composite materials like carbon fiber-reinforced polymer (CFRP) or fiberglass could be used, offering superior strength with reduced weight. These materials can be further treated or coated for enhanced durability, such as powder coating for steel or anodization for aluminum, to withstand wear and environmental exposure. By using such materials, the modules 200, 400 and cantilever arms 500 achieve a balance of robustness, lightweight construction, and long-term reliability, making them suitable for various installation environments and rough opening dimensions.

In one or more embodiments of the disclosure, the cantilever arms 500 are designed to allow the manufacturer of the stairway system 1001 to adjust the distance D between the forward structural module 200 and the rear structural module 400 as desired, accommodating various rough opening dimensions. The cantilever length portion of the cantilever arms 500 typically ranges, for example, from 20 inches to 25 inches, enabling the overall length of the adaptive supporting structure 1000 to vary, for example, between 50 inches to 65 inches. This adjustability ensures compatibility with a wide range of rough openings (RO) dimensions in attics or upper structures intended to receive the stairway system 1001.

In one or more embodiment, the manufacturer can set the distance D between the forward and rear structural modules 200, 400 anywhere between a zero distance, where the modules 200, 400 are effectively adjacent to each other for the smallest rough openings, and a maximum distance, such as 20 inches for longer openings. This adjustment is achieved by securing the rear structural module 400 to preset positions along the cantilever arms 500 using structural fasteners, such bolts, rivets or others through holes 501-505. The cantilever arms 500 are equipped with predefined mounting holes 501-505 that enable precise and secure positioning of the rear structural module 400, ensuring structural stability.

Figure 5:
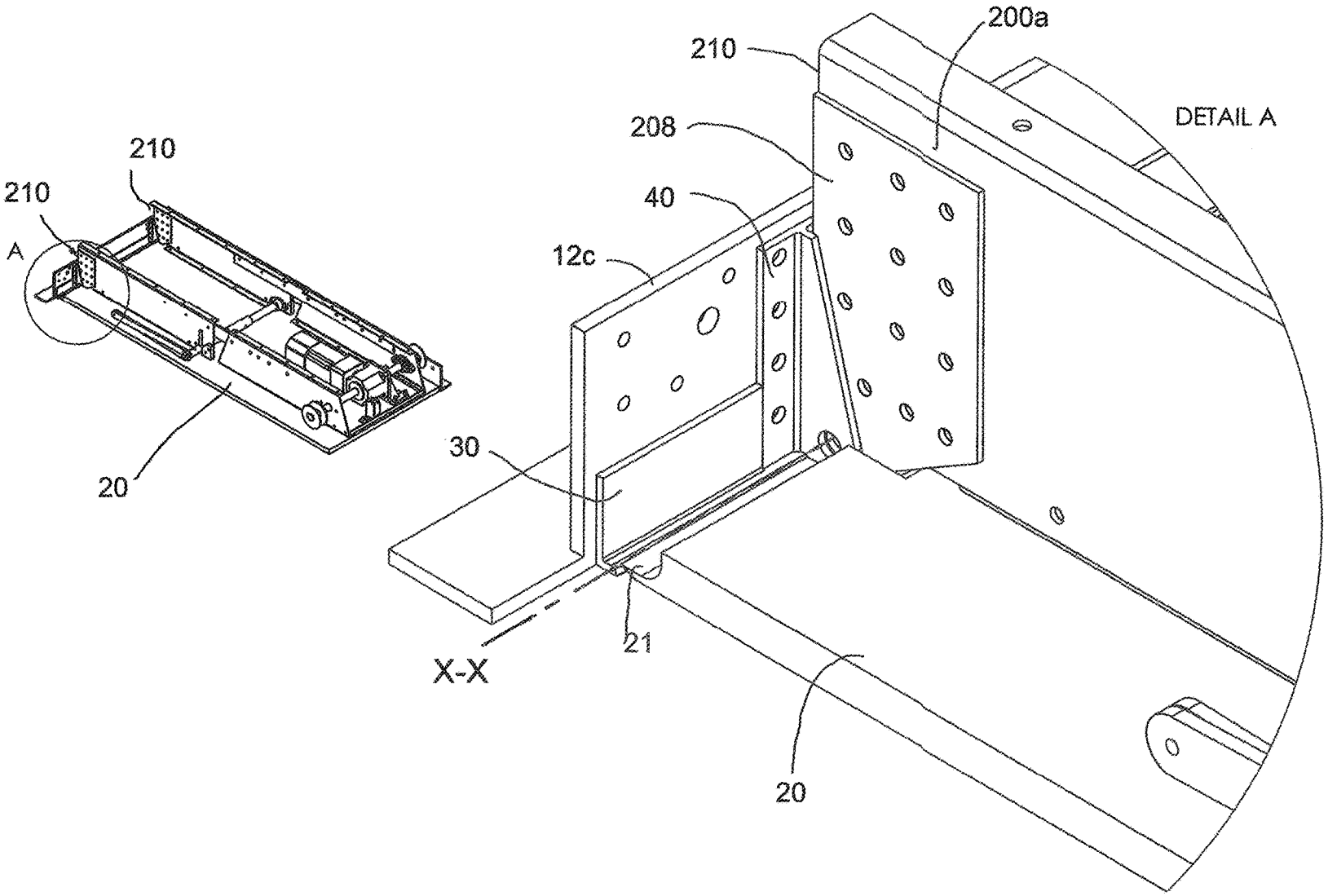
FIG. 5 shows the forward structural module, in its closed position, hinged on the framing structure that surrounds an opening to provide access to a space above or below an elevated structure.

In one or more embodiments, once the distance D between the modules 200, 400 is set, the cover 20 and the upper ladder fixed section 600 can be positioned and fastened to the modules 200, 400. The fixed section 600 is fastened on top of the structural modules (FIGS. FIGS. 7, 8*a*) while the cover 20 is fastened to the bottom of the modules (FIG. 5, 5*a*, 8). Both the forward and rear structural modules 200, 400 are specifically designed with a plurality of holes 211-215 and 411-415 that allow the fixed ladder section 600 to be securely attached in the desired position. This modular design ensures that the stairway system 1001 is properly aligned and that the fixed ladder section 600 provides a stable base for the one or more sliding ladder sections. The cantilever arms 500 are the spacing elements of the forward and rear structural modules 200, 400 for a predefined rough opening dimension while the fixed section 600 bolts to the top of the forward and rear structural modules for bridging both modules together. The fixed section is the section that supports all the sliding sections of the ladder. This arrangement confers structural integrity and maintains safety to the overall ladder system during operation. The adjustment capability of the modules 200, 400 leads to a reduced manufacturing cost of the stairway system 1000 as the same structural modules 200, 400 are used for whatever rough opening (RO) dimensions the stairway system 1000 has to be designed for. As also shown in FIG. 1, a balancing arms mechanism 220 integrated into the forward structural module 200 governs its pivoting angle. This mechanism 220 includes arms 201*a*, 201*c* connected by rods 201*b*, 201*d* and a shaft coupler 204, which ensures synchronized pivoting. Structural pins 203 on the rods 201*b*, 201*d* interact with limit fittings 205 secured to, respectively, the frames 200*a*, 200*b* to precisely control the forward structural module's 200 rotation. The stairway system 1001 ensures smooth operation and limits rotational angular value during stairway deployment.

The motorized system 100, mounted on the rear structural module 400, controls both the opening and closing of the forward structural module 200 and the extension and retraction of the sliding ladder sections 700, 800. As shown in FIGS. 9*a-b*, the motorized system 100 includes a gearmotor 402, reels 407, and a cable mechanism including one or more cables 403 for transferring loads. This setup ensures efficient and controlled movement of the stairway components.

The adaptive supporting structure 1000 bridges the forward and rear structural modules 200, 400 with a fixed ladder section 600 (see FIG. 7) that acts as the base for extendable sliding ladder sections 700, 800. This configuration ensures that the stairway system 1001 is modular, allowing for efficient assembly and use across varying ceiling opening dimensions.

Additionally, a cover 20 is attached to the underside of the structural modules 200, 400. This cover 20 works in tandem with a fixed forward fairing 30 (see FIG. 5) to close the rough opening when the stairway system 1001 is retracted. This ensures a seamless and aesthetically pleasing integration with the ceiling.

Overall, FIG. 1 illustrates a robust, modular, and adaptable design. The structure's ability to adjust the positioning of the rear structural module 400 along the cantilever arms 500 reduces production cost making it more affordable to potential customers. This combination of structural stability and operational efficiency makes it a highly effective solution for variable residential and commercial applications.

Figure 2:
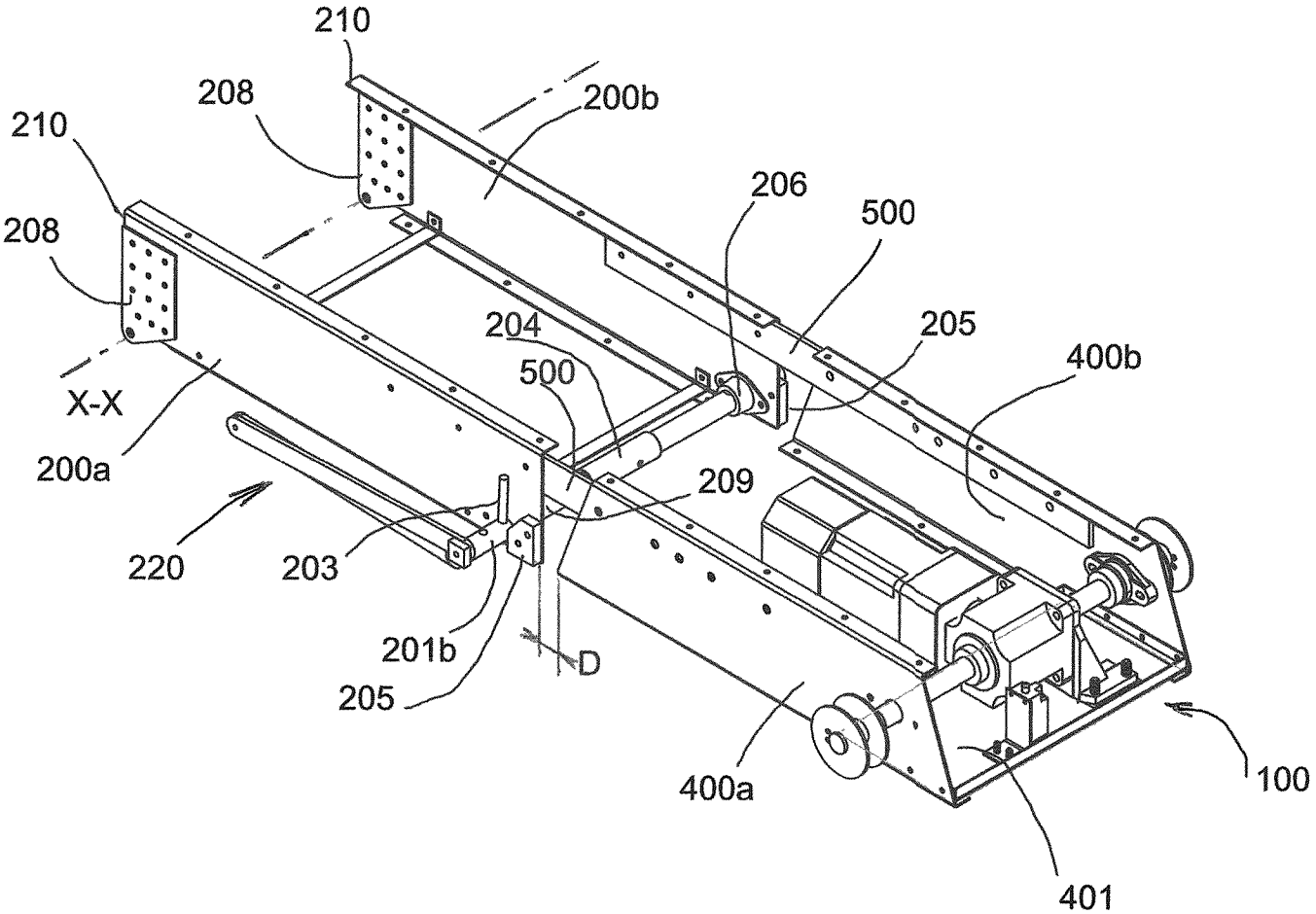
FIG. 2 is a perspective view, shown in its closed position and in its shortest adjustment, of the adaptive supporting structure according to an embodiment of the disclosure.

FIG. 2 depicts the adaptive supporting structure in a configuration designed to accommodate a smaller rough opening (RO) in the ceiling. In this arrangement, the forward structural module 200 and the rear structural module 400 are positioned closer together with a smaller distance D between them, showcasing the system's adjustability to different RO dimensions.

The rear structural module 400 remains mechanically attached to the forward structural module 200 through cantilever arms 500. Unlike in FIG. 1, the rear structural module 400 is positioned closer to the forward structural module 200 by utilizing holes 501-505 further up the cantilever arms 500, which are equipped with preset attachment points. This allows the rear structural module 400 supporting the motorized system 100 while maintaining the structural alignment required for reliable operation.

As explained hereinafter and shown in FIG. 7, the fixed stairway section 600 bridges the forward and rear structural modules 200, 400, providing a base for the sliding ladder sections 700, 800 (shown in FIGS. 9*a*, 9*b*). This fixed section 600 is built to accommodate the spacing between the forward and rear structural modules 200, 400, ensuring stability across different configurations.

The configuration shown in FIG. 2 demonstrates the system's ability to adapt to smaller rough openings while maintaining its functionality and structural integrity. By reducing the spacing between the forward and rear structural modules 200, 400, the design eliminates the need for custom-sized components, simplifying manufacturing and reducing production costs. The versatility of the cantilever arms 500 and the modular nature of the structural elements 200, 400 ensure compatibility with a wide range of ceiling opening dimensions.

Figure 3:
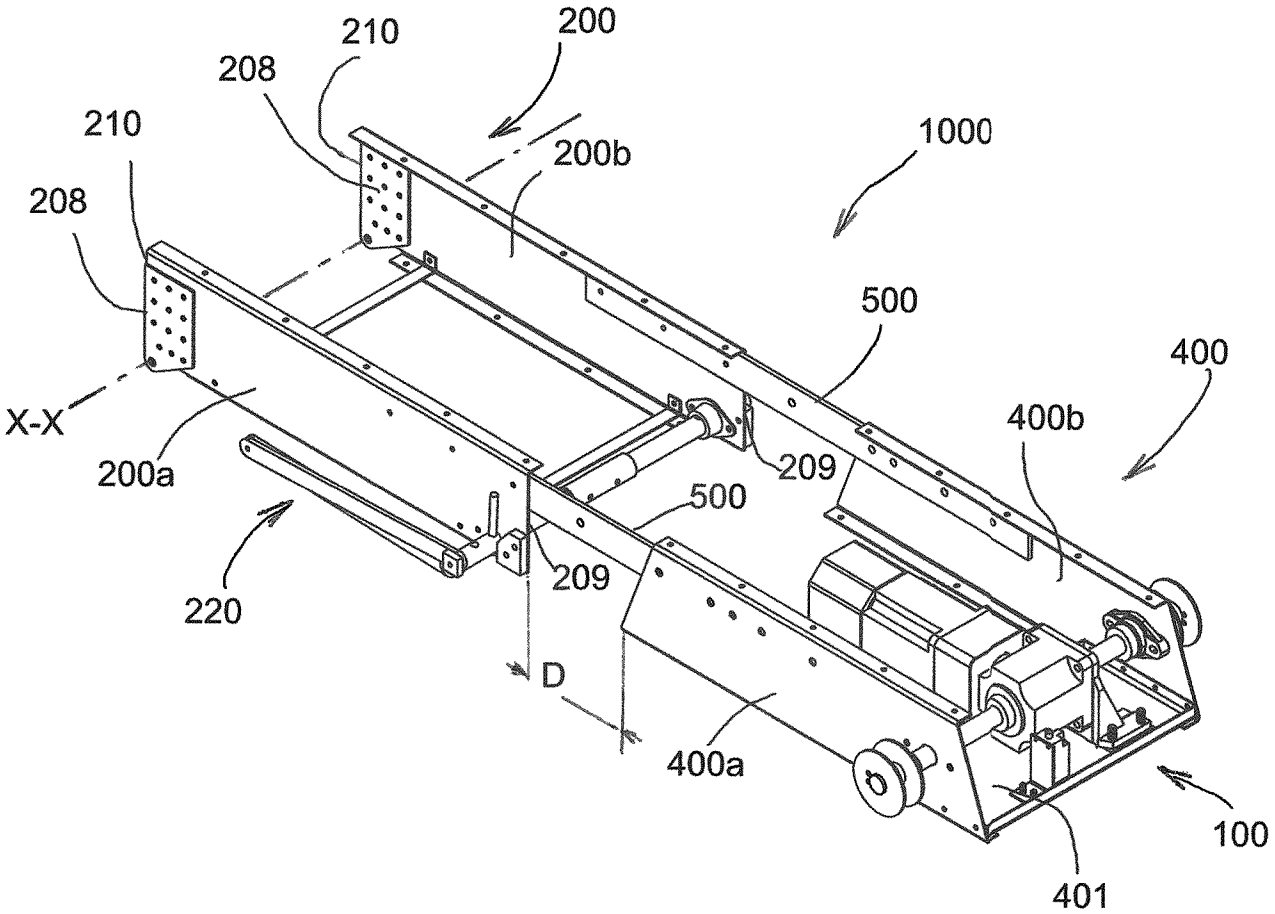
FIG. 3 is a perspective view, shown in its closed position and in an intermediate adjustment, of the adaptive supporting structure according to an embodiment of the disclosure.

Now referring to FIG. 3, this figure illustrates the adaptive supporting structure 1000 configured with an increased spacing between the forward structural module 200 and the rear structural module 400 compared to the configuration shown in FIG. 2. This adjustment accommodates a longer rough opening (RO) in the ceiling, such as those found in attics or elevated structures that require the stairway system.

In this configuration, the cantilever arms 500, which connect the forward and rear structural modules 200, 400, are used to extend the distance between the modules. The rear structural module 400 is mounted further along the length of the cantilever arms 500 by utilizing preset holes positioned closer to the arms' ends. This adjustability allows the adaptive supporting structure 1000 to increase its overall length to suit longer rough openings. For example, while FIG. 2 may demonstrate a compact configuration for a smaller opening, FIG. 3 showcases the system's ability to extend to accommodate a longer RO.

The forward structural module 200, comprising C-shaped frames 200*a*, 200*b*, remains pivotally connected to the framing structure (not shown in FIG. 3) via clevis fittings 208 at the forward end 210. The rear structural module 400, with its own C-shaped frames 400*a*, 400*b*, is mechanically attached to the cantilever arms 500 at the adjusted distance. This increased spacing ensures that both modules 200, 400 provide stable and aligned support for the fixed ladder section 600 (not shown in this figure) that bridges both modules for support of the one or more sliding ladder sections for stairway operation.

This configuration of FIG. 3 demonstrates the adaptability of the cantilever arms 500, which are specifically engineered to support the structural loads imposed by the modules 200, 400 and the ladder system without deformation, even when extended. By securely fastening the rear structural module 400 to the cantilever arms 500 using fasteners, such as bolts, rivets or other means, the system 1000 achieves the required spacing while maintaining stability and durability.

Figure 4:
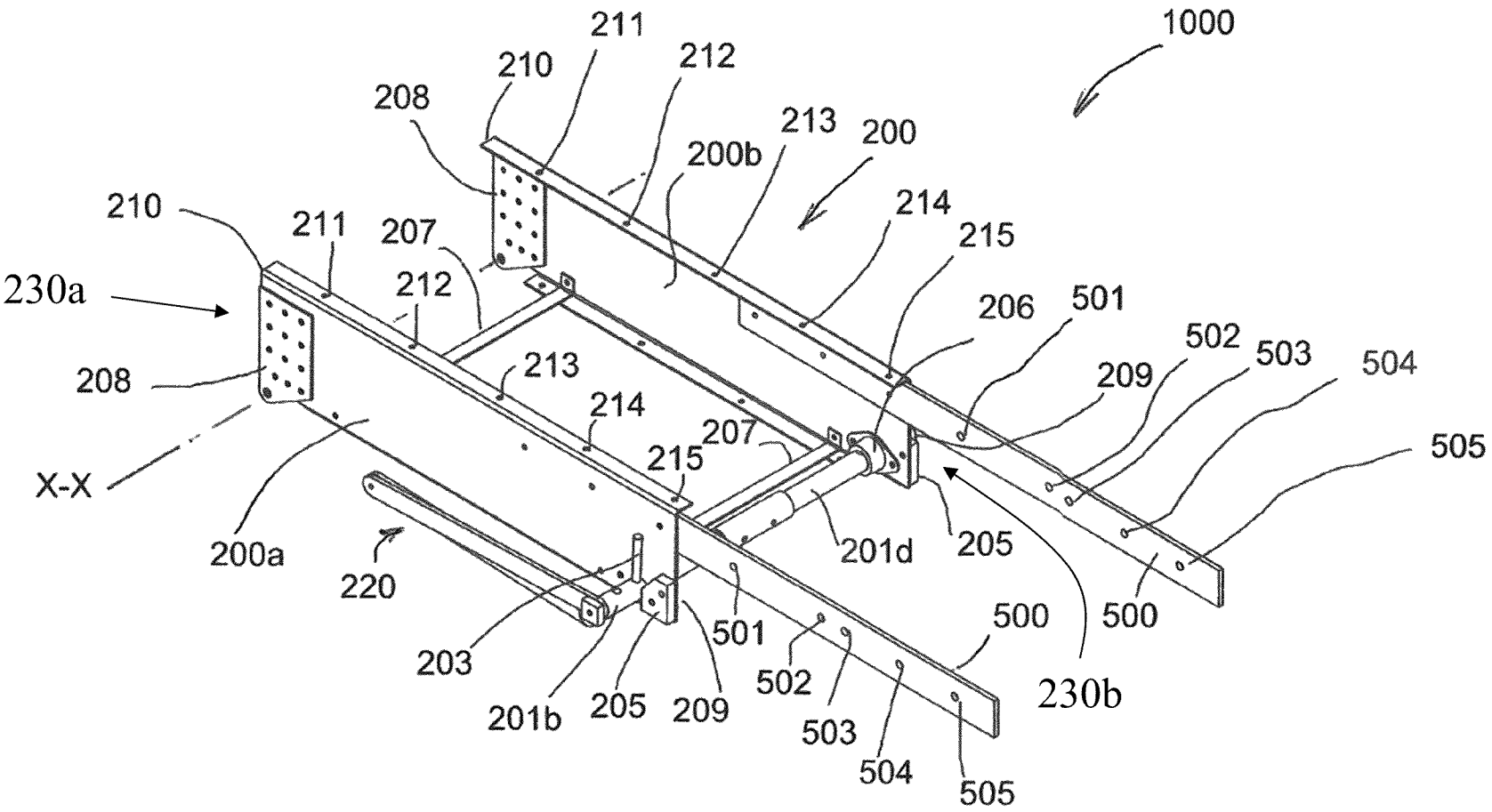
FIG. 4 is a perspective view of the forward structural module of the adaptive supporting structure according to an embodiment of the disclosure.

FIG. 4 illustrates the forward structural module 200 and its associated components in detail. This forward structural module 200 forms a part of the adaptive supporting structure 1000, designed to provide robust support and precise control over the stairway's 1001 motion. FIG. 4 highlights the framework, pivoting mechanisms, and support elements integral to the system's operation. The forward structural module 200 comprises a first end 230*a* and a second end 230*b*.

The forward structural module 200 is composed of, for example, two C-shaped frames 200*a*, 200*b* that form its main structural framework. These frames 200*a*, 200*b* are configured for supporting the fixed and movable stairway sections 600, 700, 800 and other system components. At the forward ends 210 of the module, fittings 208 are installed to enable pivoting motion about the pivot axis XX. As shown in FIG. 5, these fittings 208 attach to clevis-type connectors 40 on the supporting frame section 12*c*, ensuring smooth and controlled rotation between open and closed positions of the adaptive structure 1000 and thus the stairway system 1001.

The forward structural module 200 incorporates an angular control mechanism to manage its opening angle value. This angular control mechanism includes rods 201*b*, 201*d*, which are mounted within the walls 200*a*, 200*b* using bearings 206. These rods 201*b*, 201*d* act as the pivoting axis for the balancing arms 201*a*, 201*c*, which extend outward from the forward structural module 200 and connect pivotally to the supporting structure or frame 10 and in particular to frame sections 12*b* and 12*d* (shown in FIG. 8). The balancing arms 201*a*, 201*c* synchronize the motion of the forward structural module 200, ensuring stability and precise angular control.

Additionally, structural pins 203 are mounted on the rods 201*b*, 201*d* and interact with angular limit fittings 205 fixed to the walls 200*a*, 200*b* of the forward structural module 200. These pins 203 restrict the rotational value of the forward structural module 200, preventing it from exceeding the predefined opening angle. This ensures controlled and stable operation during deployment and retraction of the stairway.

The forward structural module 200 also plays a role in supporting other components of the stairway. The fixed stairway section 600 shown in FIG. 7, which bridges the forward and rear structural modules 200, 400, is partially supported by the forward structural module 200. This fixed section 600 acts as the base for the sliding ladder sections 700, 800, ensuring a stable and reliable structure. Additionally, the lower portion of the forward structure module 200 supports the cover 20 (shown in FIGS. 5 and 8), which is responsible for partially closing the rough opening in the ceiling when the stairway system 1001 is retracted.

The structural design of the forward structural module 200 is reinforced for durability and adaptability. The walls 200*a*, 200*b* are engineered to handle the loads exerted by the stairway during operation while supporting the angular control mechanism. Preset holes along the walls 200*a*, 200*b* enable the attachment of various components, making the module adaptable to different rough opening dimensions. At the rear ends 209, the forward structural module 200 provides attachment points for the cantilever arms 500, which connect to and secure the rear structural module 400. The cantilever arms 500 can be attached to the forward structural module 200 using fasteners (e.g. bolts, nuts, screws), thus making the cantilever arms detachable, or else can be welded to the to the forward structural module 200.

The forward ends 210 of the forward structural module 200 are equipped with fittings 208 that serve as the interface for the module's pivoting motion. These fittings 208 attach securely to the supporting frame's clevis fittings 40 (see FIG. 5), enabling reliable and precise motion of the forward structural module 200.

Figure 4A:
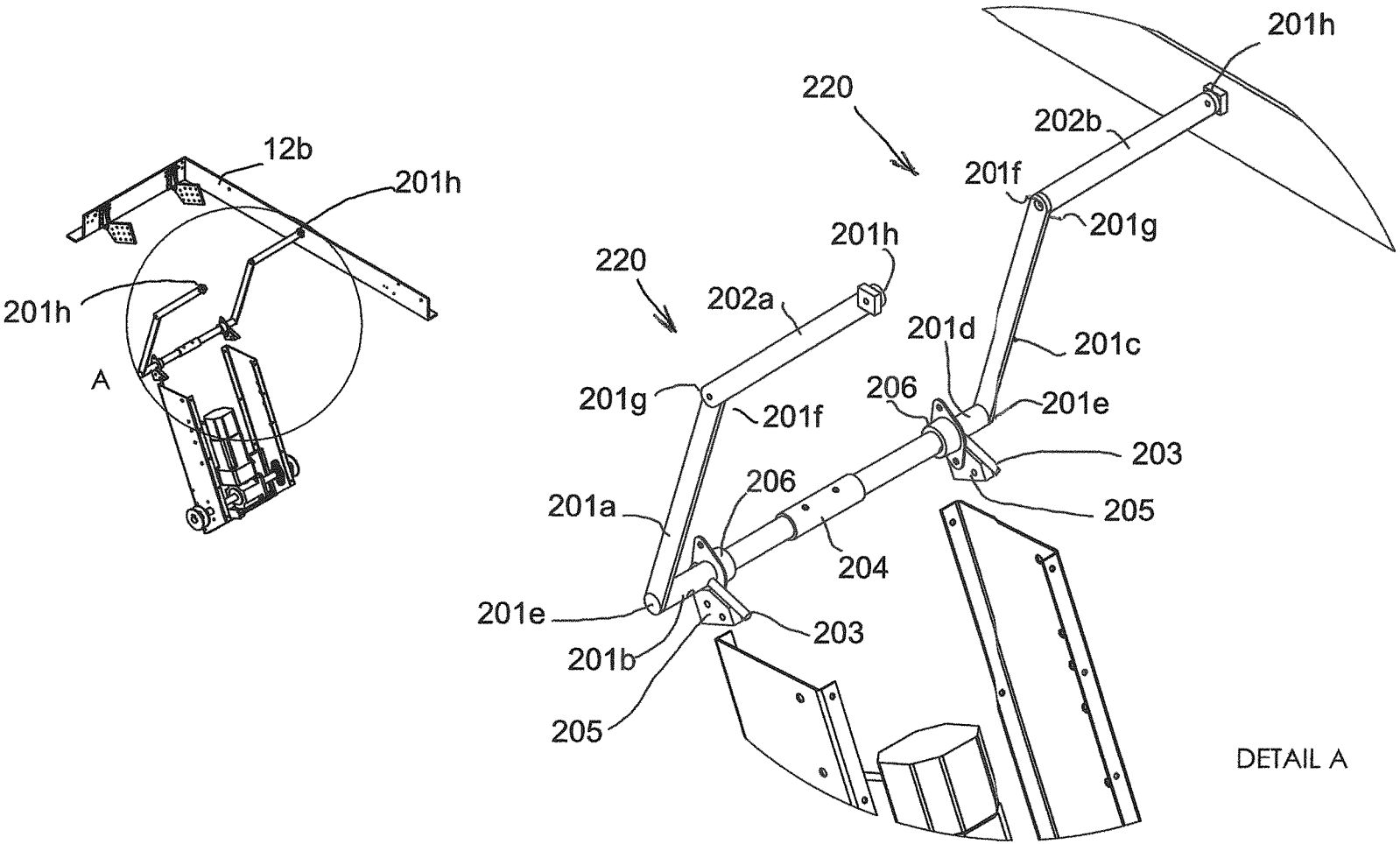
FIG. 4*a* is a perspective view of the balancing arms system that limit the value of the opening angle of the forward structural module.

FIG. 4*a* provides a detailed view of the balancing arms mechanism 220 and the components responsible for controlling the value of the opening angle of the forward structural module 200. This figure illustrates how the balancing arms mechanism 220 ensures stable and controlled pivoting of the forward structural module 200.

The balancing arms mechanism 220 comprises two sets of balancing arms 201*a*, 201*b* and supporting arms 202*a*, 202*b*. Each balancing arm 201*a*, 201*c* is mounted on rods 201*b*, 201*d*, which serve as pivot points. These rods 201*b*, 201*d* are supported by bearings 206 attached to the walls 200*a*, 200*b* of the forward structural module 200. The balancing arms 201*a*, 201*c* extend outward and pivotally connect to the supporting arms 202*a*, 202*b* at their first ends 201*f*, 201*g*.

The other ends of the supporting arms 201*h* are pivotally attached to the fixed supporting frame sections 12*b*, 12*d* surrounding the rough opening. This connection ensures synchronized motion between the forward structural module 200 and the balancing arms mechanism 220 as the forward structural module 200 transitions between open and closed positions. The integration of these arms 201*a*, 201*c* allows for smooth and controlled operation, ensuring the module's stability during use.

The angular control of the forward structural module 200 is further enhanced by the inclusion of structural pins 203 and angular limit fittings 205. These pins 203 are installed on the rods 201*b*, 201*d* (e.g. they can be screwed or welded to the rods) and interact with the angular limit fittings 205, which are fixed to the walls 200*a*, 200*b* of the forward structural module 200. As the forward structural module 200 pivots, the structural pins 203 move along with or rotate in unison with the rods 201*b*, 201*d*. When the forward structural module 200 reaches its maximum opening angle, the pins 203 abut against the angular limit fittings 205, halting further rotation and positioning the adaptive supporting structure 1000, the cover 20 and the ladder sections 600, 700 and 800 are a desired angle. Once the pins 203 abut the angular limit fittings 205, the movable ladder sections 700, 800 can be extended by gravity force at a speed controlled by the gear ratio of the motorized system as will be explained hereinafter. This design prevents over-rotation and ensures the forward structural module 200 opens to a precise, predefined angle.

In addition, shaft coupler 204 connects the two rods 201*b*, 201*d*, effectively making them function as a single unit. This coupling ensures synchronized motion of the balancing arms 201*a*, 201*c* on both sides of the module. By maintaining uniform operation, the coupler enhances the overall stability and durability of the system. It will be appreciated that in other embodiments of the disclosure, the two rods 201*b*, 201*d* and shaft coupler 204 may be replaced by a single rod.

The detailed view in FIG. 4*a* demonstrates how the balancing arms mechanism 220 interacts with the forward structural module 200 and the supporting frame section 12*c* to achieve precise control. The combined action of the balancing arms 201*a*, 201*c*, supporting arms 202*a*, 202*b*, structural pins 203, and angular limit fittings 205 provides smooth operation while ensuring the safety and reliability of the adaptive supporting structure 1000.

Figure 4B:
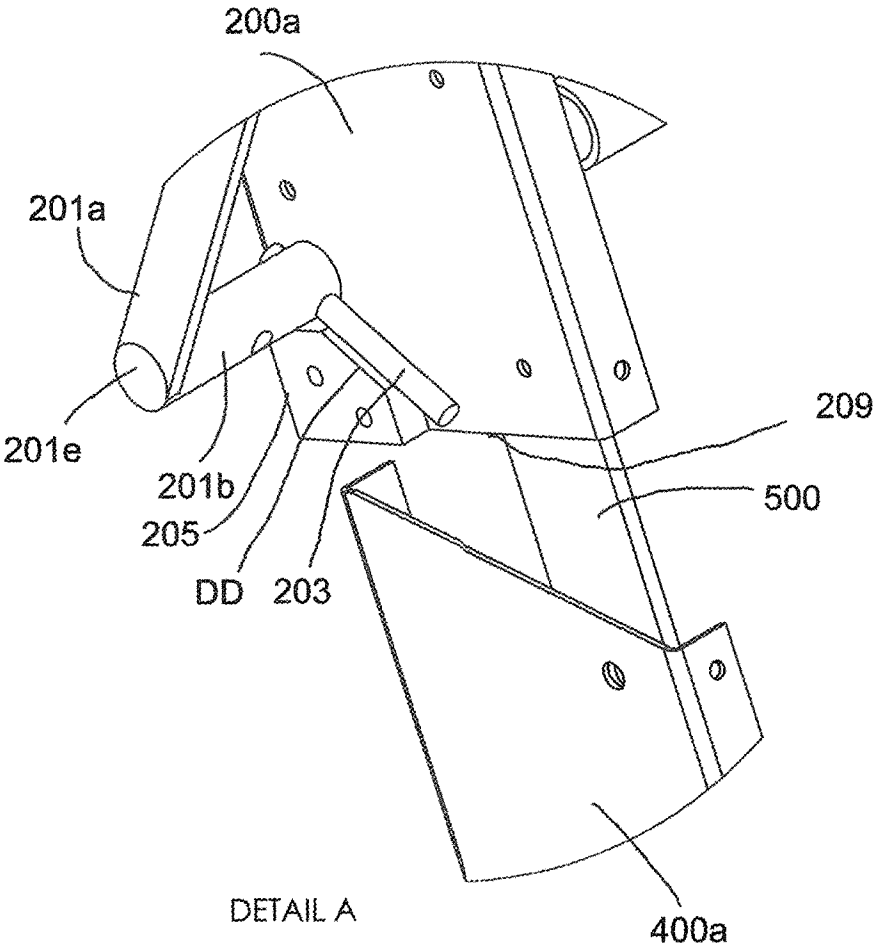
FIG. 4*b* is a magnified view of the system of FIG. 4*a* for limiting the value of the angle of the forward structural module.
Figure 4B:
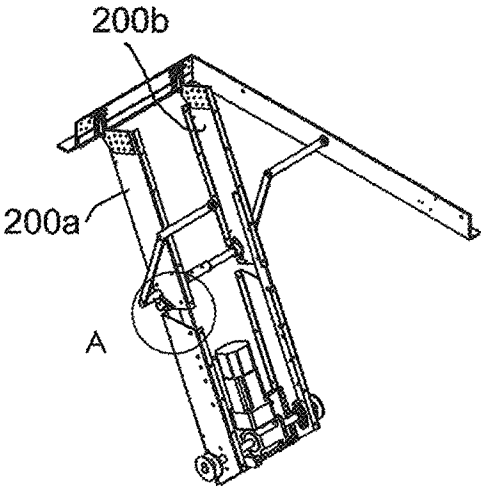

Now referring to FIG. 4*b*, the forward structural module 200 includes C-shaped frames 200*a*, 200*b*, which form the primary structural walls 200*a*, 200*b*. These walls 200*a*, 200*b* house components of the angular control system, including rods 201*b*, 201*d*, balancing arms 201*a*, 201*c*, and structural pins 203. The rods 201*b*, 201*d* are supported within the walls via bearings 206 arranged on the walls 200*a*, 200*b* and serve as the pivoting axis for the balancing arms 201*a*, 201*c*.

The balancing arms 201*a*, 201*c* are fixedly connected to the rods 201*b*, 201*d* at their first ends 201*e*, allowing them to pivot freely. The balancing arms 201*a*, 201*c* extend outward and are pivotally connected to corresponding supporting arms 202*a*, 202*b* (FIG. 4*a*), which link the balancing arms 201*a*, 201*c* to the fixed supporting frame 10 of the stairway system 1000. This arrangement ensures synchronized movement of the balancing arms 201*a*, 201*c* during the opening and closing of the forward structural module 200.

The rods 201*b*, 201*d* interact with angular limit fittings 205 fixed to the walls 200*a*, 200*b* of the forward structural module 200. The angular limit fittings 205 are structural components that define the maximum opening angle of the module. In particular, as shown in FIG. 4*b*, the angular limit fittings 205 have an angular face DD that is angled so as to define the angular orientation of the forward structural module 200 and thus the stairway system 1001, relative to the ground and/or the upper structure (e.g. attic) when the stairway system 1001 is in the open position and the one or more ladder sections are extended. Structural pins 203 are mounted on the rods 201*b*, 201*d* and interact with these fittings 205. As the forward structural module 200 pivots to its open position, the pins 203 come into contact with the angular limit fittings 205, halting further rotation and ensuring that the forward structural module 200 and thus the stairway 1001 does not exceed the predefined angle. In an embodiment, the predefined angle may be in the range from 20 degrees to 35 degrees relative to a direction perpendicular to the ceiling.

The fixed stairway section 600 (see FIG. 7) is partially supported by the forward structural module 200 and interacts with its walls 200*a*, 200*b*. This section 600 bridges the forward structural module 200 with the rear structural module (not shown in FIG. 4*b*), providing a stable base for the sliding ladder sections of the adaptive stairway system 1001.

The angular limit fittings 205 are shown as components in maintaining structural stability during operation. These fittings, along with the pins 203, prevent over-rotation of the forward structural module 200 and ensure smooth, controlled pivoting. The precise positioning of the fittings 205 within the module's walls ensures reliability and durability in various operating conditions.

FIG. 5 illustrates the forward structural module 200 in its closed position, highlighting its interaction with the section 12*c* of the framing structure 10 that surrounds the rough opening (RO) in the ceiling. FIG. 5 provides a detailed view of the pivotal connections, support mechanisms, and how the module interfaces with other structural elements.

These frames 200*a*, 200*b* are securely hinged to the framing structure section 12*c* using fittings 208 attached to the frames 200*a,b* and that cooperate with clevis-type fittings 40 attached to the frame section 12*c*. The fittings 208 are mounted on the forward ends 210 of the forward structural module 200, enabling it to pivot about the defined pivot axis XX. This pivoting motion allows the forward structural module 200 to transition smoothly between open and closed positions.

FIG. 5 also highlights the cover 20, which is supported by the lower portion of the forward structural modules 200, 400. When the forward structural module 200 is in the closed position, the rear cover 20 is aligned with a fixed fairing 30, which is attached to the framing structure section 12*c*. Together, the cover 20 and fixed fairing 30 close off the rough opening in the ceiling, creating a seamless and aesthetically pleasing tight closure. The forward edge 21 of the rear cover 20 fits neatly within the fixed fairing 30, ensuring a tight fit when the module is retracted.

The preset holes in the frames 200*a*, 200*b* allow for the attachment of additional structural component, such as the fixed stairway section. These holes enhance the adaptability of the forward structural module 200, enabling it to accommodate various rough opening dimensions and installation requirements.

The structural design ensures that the module is both durable and functional. The clevis fittings 40 and fittings 208 provide a robust pivoting connection to the framing structure 12*c*, while the alignment of the cover 20 with the fixed fairing 30 ensures a tight fit and a clean appearance when the stairway is retracted.

Figure 5A:
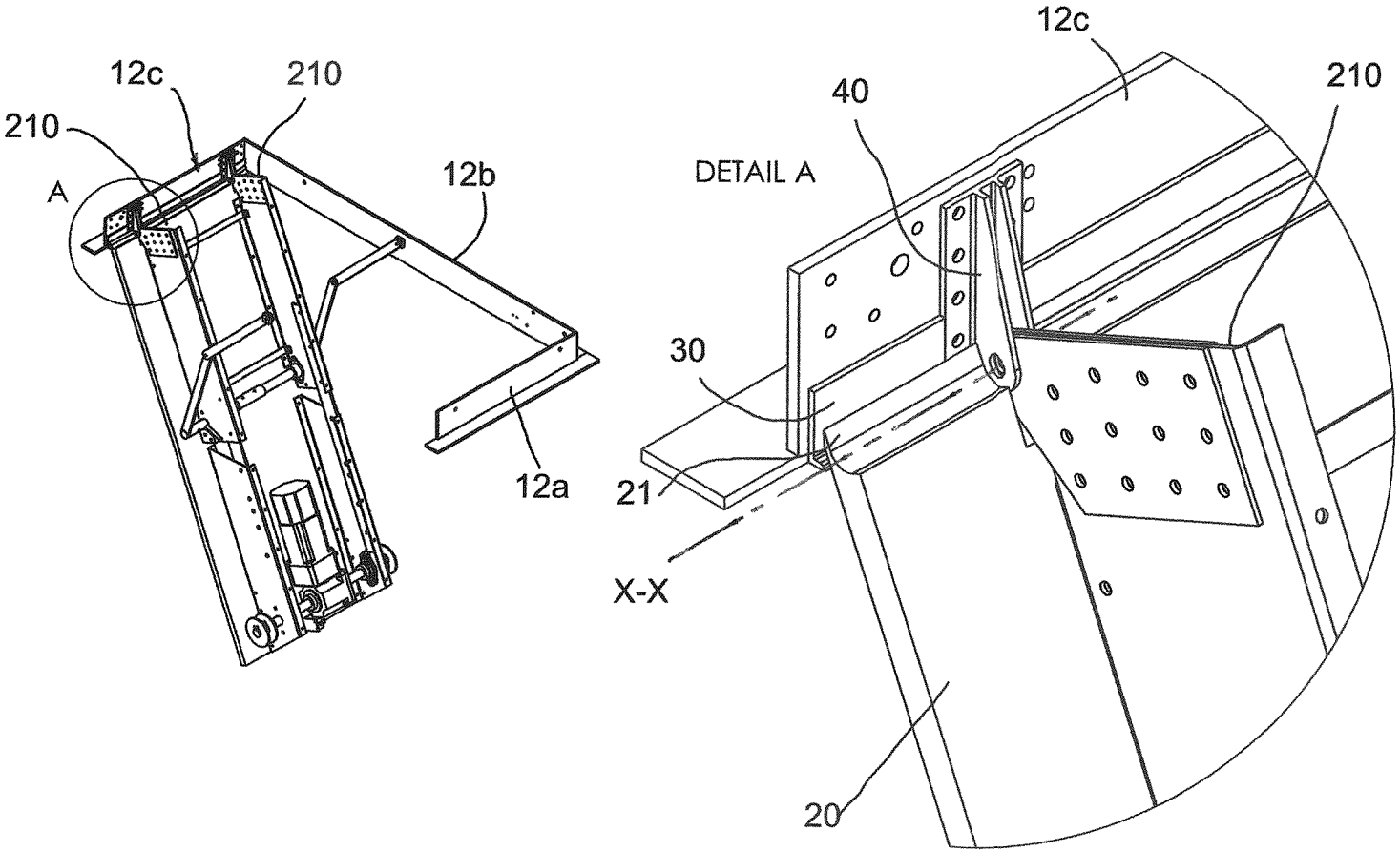
FIG. 5*a* is a view of FIG. 5 with the adaptive structure shown in its opened position.

FIG. 5*a* provides a detailed view of the forward structural module 200 in its opened position, illustrating the rotation of the module and the pivotal motion of the fittings 208 relative to the clevis fittings 40 on the framing structure 12*c*. This figure emphasizes the functional interaction between these components during the opening motion of the adaptive supporting structure.

The forward structural module 200, which comprises two C-shaped frames 200*a*, 200*b*, is shown pivoting about the pivot axis. This pivotal motion is facilitated by the fittings 208 mounted at the forward ends 210 of the forward structural module 200, which rotate relative to the clevis fittings 40. The clevis fittings 40 are securely attached to the framing structure section 12*c* of the frame 10 that surrounds the rough opening (RO) in the ceiling. The rotational relationship between these fittings 208, 40 ensures a smooth and controlled motion as the forward module transitions from the closed to the open position.

As the forward structural module 200 opens, the cover 20 attached to its underside of the forward structural module 200 also rotates. The forward edge 21 of the cover 20 moves inside the fixed fairing 30, which remains stationary and attached to the framing structure section 12*c*. This interaction ensures that the cover 20 maintains alignment with the fairing 30 throughout the pivoting motion of the forward structural module 200.

FIG. 5*a* highlights the angular movement of the forward structural module 200 and demonstrates how the pivotal connection at the fittings 208, 40 enables this motion. The fittings 208, mechanically attached to the forward structural module are designed to handle the structural loads, as they move in unison with the forward structural module 200. The clevis fittings 40, on the other hand, remain fixed to the framing structure section 12*c*, acting as stable anchors for the module's pivoting action.

Figure 6:
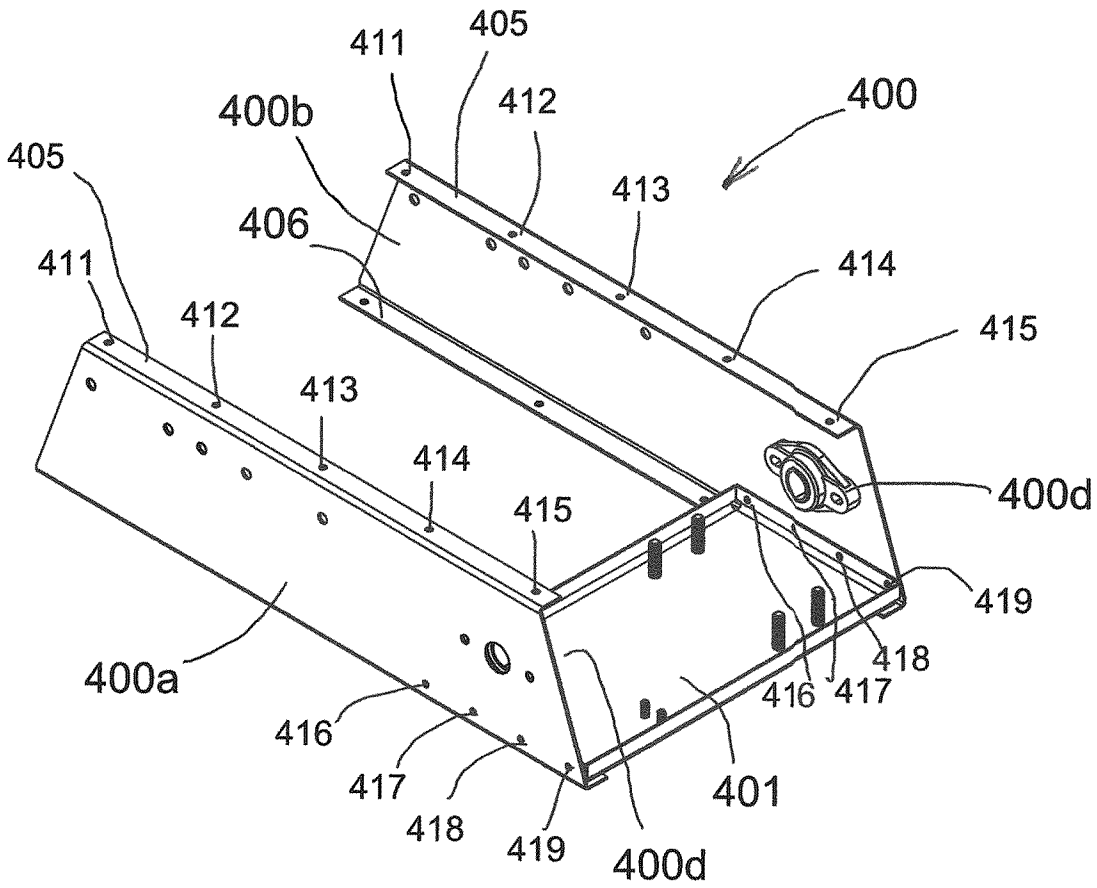
FIG. 6 is a perspective view of the rear structural module of the adaptive supporting structure according to an embodiment of the disclosure.

FIG. 6 provides a detailed view of the rear structural module 400, which forms a part of the adaptive supporting structure 1000. This rear structural module 400 is designed to also provide support for the fixed stairway section and the cover 20. Moreover, the rear structural module 400 provides support for the motorized system 100 (see FIGS. 7, 8 and 9) responsible for operating the stairway. FIG. 6 highlights the module's structural elements and its adaptability for various rough opening (RO) dimensions.

The rear structural module 400 is composed of two C-shaped frames 400*a*, 400*b*. These frames 400*a*, 400*b* are designed to ensure structural rigidity while minimizing weight. The upper surface 405 of the frames 400*a*, 400*b* support the rear portion of the fixed stairway section, which bridges the forward and rear structural modules 200, 400. This fixed stairway section 600 serves as a base for the sliding ladder sections (not shown in this figure). The lower surface 406 of the frames 400*a*, 400*b* support the rear portion of the cover 20, which works with the forward module 200 to partially close the rough opening in the ceiling when the stairway is retracted.

The rear module 400 is shown equipped with a pan or platform 401, which is securely mounted between the frames 400*a*, 400*b*. This pan or platform 401 serves as the mounting base for the motorized system 100, which includes components such as the gearmotor 402, shafts 404 reels 407, and associated cables 403 (FIG. 9*b*). The motorized system 100 is responsible for controlling the speed of extending and retracting the sliding ladder sections 700, 800 (see FIGS. 9*a-b*), as well as the pivoting opening speed of the forward and rear modules 200, 400 during operation of the stairway system 1001.

FIG. 6 also highlights the adaptability of the rear structural module 400 for varying rough opening dimensions. The rear structural module 400 is mechanically attached to cantilever arms 500 (not shown in this figure) extending from the forward structural module 200. These cantilever arms 500 include preset holes that allow the rear structural module 400 to be positioned at different distances from the forward structural module 200, depending on the rough opening's length. This adjustability ensures that the same forward and rear structural modules 200, 400 can be used for a wide range of rough openings dimensions, reducing the manufacturing cost of the stairway.

The C-shaped frames 400*a*, 400*b* are equipped with preset holes 411-415 and 416-419 along their length. These holes facilitate the attachment of additional components, such as the fixed stairway section and the platform 401 that supports the motorized system. The modular design simplifies the assembly of the stairway during manufacturing hence decreases its cost.

Figure 7:
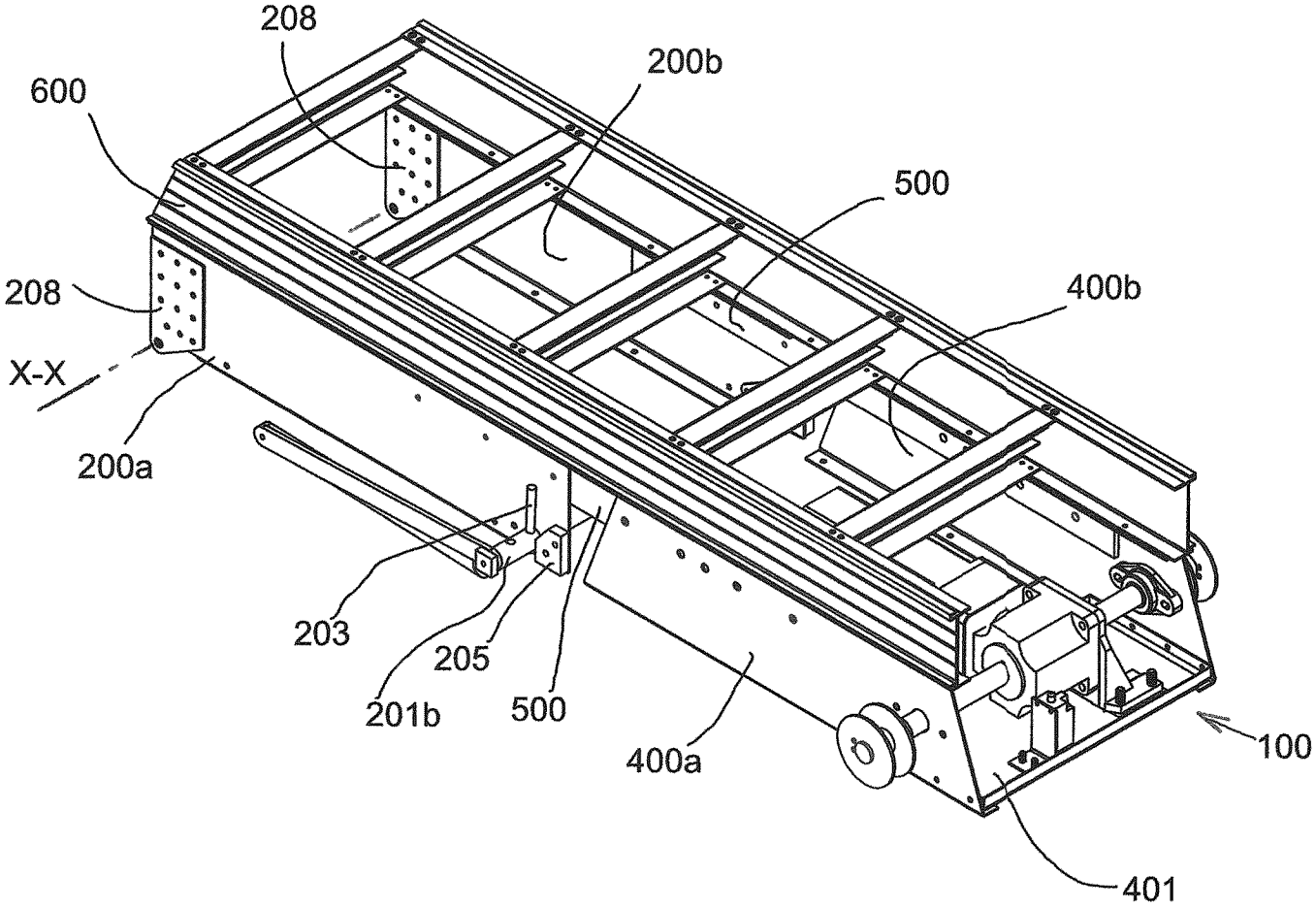
FIG. 7 is a view of FIG. 2 with the fixed section of the stairway bridging the forward and rear structural modules according to an embodiment of the disclosure.

FIG. 7 illustrates the forward structural module 200 and the rear structural module 400 connected to each other, with a fixed ladder section 600 securely attached to their top surfaces. This figure provides a detailed depiction of the structural integration of these components and the placement of the motorized system 100, which drives the operation of the adaptive stairway system.

The forward structural module 200 consists of two C-shaped frames 200*a*, 200*b*, which provide partial support for the fixed ladder section 600. The forward structural module 200 is shown connected to the rear structural module 400 via cantilever arms 500. These arms 500 extend from the rear of the forward structural module 200 and allow for adjustable positioning of the rear structural module 400 based on the length of the rough opening (RO). This flexibility ensures that the stairway system 1001 can be customized to accommodate a wide range of RO dimensions.

The rear structural module 400 also comprises two C-shaped frames 400*a*, 400*b*, which complement the forward structural module's structure. The rear structural module 400 supports the pan or platform 401 that houses the motorized system 100. This motorized system 100 includes components such as a gearmotor 402, shafts 404 and reels 407, and associated cables 403 (FIG. 9*b*) which facilitate the controlled extension and retraction of the sliding ladder sections (not depicted in this figure). The motorized system 100 is securely mounted to the pan 401, ensuring stability and precise operation.

The fixed ladder section 600 is shown bridging the forward and rear structural modules 200, 400. This fixed section 600 is bolted to the top surfaces of both modules 200, 400, creating a continuous and stable base for the one or more sliding ladder sections 700, 800 as shown in FIGS. 9*a*, 9*b*. The fixed ladder section 600 maintains alignment and structural integrity during the operation of the stairway system 1001. It is designed to withstand the loads exerted during use and provides a foundation for the one or more extendable ladder sections that slide outward during deployment.

The figure highlights how the forward and rear structural modules 200, 400 work together to form a unified system. The C-shaped frames 200*a*, 200*b*, 400*a*, 400*b* provide robust support for the fixed ladder section 600 and the motorized system 100, while the adjustable connection between the modules 200, 400 ensures versatility. The motorized system 100, mounted on the rear structural module 400, drives the opening and closing of the modules 200, 400 and the deployment of the one or more sliding ladder sections. This integration of components ensures smooth and reliable operation, even under varying loads.

Figure 8:
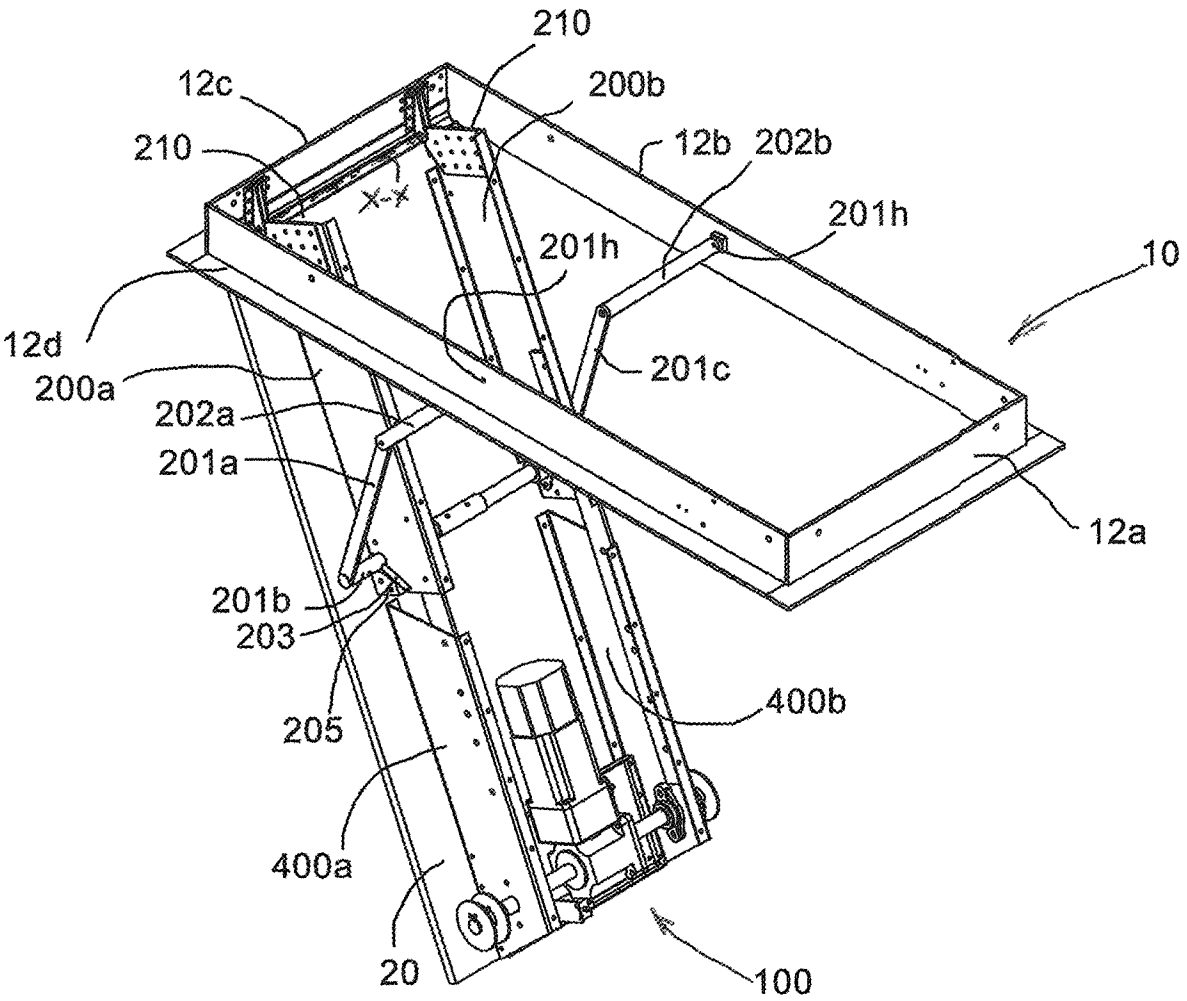
FIG. 8 is a view of FIG. 5*a* showing the adaptive structure fully opened according to an embodiment of the disclosure.
Figure 8A:
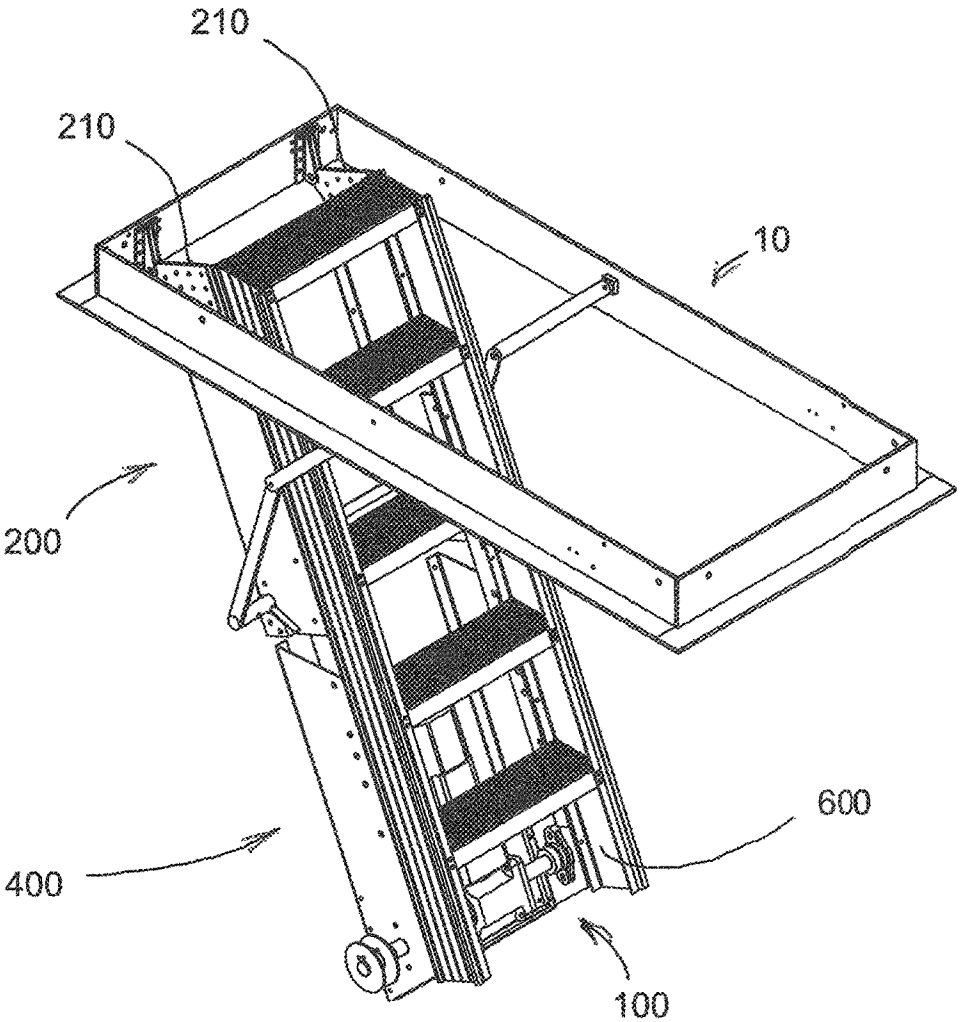
FIG. 8*a* is a view of FIG. 8 with the fixed section of the stairway bridging the forward and rear structural modules according to an embodiment of the disclosure.

FIG. 8 illustrates the forward structural module 200 and the rear structural module 400 in their deployed position, pivotally attached to the frame sections 12*c* the framing structure 10 around the rough opening (RO) in the ceiling. In this depiction, the fixed ladder section 600 and sliding ladder sections 700, 800 are omitted for clarity, allowing the structural details of the deployed modules to be more visible.

The forward structural module 200 includes the two C-shaped frames 200*a*, 200*b* that pivot about the defined pivot axis XX (FIG. 8). The forward structural module 200 is connected to the framing structure 10 via clevis-type fittings 40 that are mounted to the forward frame section 12*c* of the framing structure 10. These fittings 40 allow the forward structural module 200 to rotate smoothly from a closed position (retracted) to the open (deployed) position shown in FIG. 8.

The rear structural module 400, composed of two C-shaped frames 400*a*, 400*b*, is mechanically connected to the forward structural module 200 via cantilever arms 500. These cantilever arms 500 are attached to the rear of the forward structural module 200, enabling the rear structural module 400 to move in unison with the forward structural module 200 as it pivots about the axis XX. The rear structural module 400 is shown in its closed state, supporting the structural pan 401 that houses the motorized system 100 (FIG. 7).

The frame sections 12*a*, 12*b*, 12*c*, 12*d* of the frame 10 form a rectangular framing structure surrounding the rough opening in the ceiling. These frame sections 12*a*, 12*b*, 12*c*, 12*d* are securely mounted to the ceiling structure using structural fasteners, e.g. lag screws or other means. The forward structural module's 200 pivoting motion allows it to open away from the frame 12*c*, while the rear structural module 400 follows the motion, ensuring synchronized movement. This configuration allows the forward and rear structural modules 200, 400 to clear the rough opening entirely when in the deployed position, providing unobstructed access to the elevated space.

The cover 20, which is attached to the underside of the forward and rear structural modules 200, 400, is also visible in the deployed position (FIGS. 8, 9*a*). During the deployment, the forward edge of the rear cover 20 interacts with the fixed fairing 30, which is mounted to the framing structure section 12*c*. This ensures proper alignment and prevents misalignment or damage during operation. When the forward and rear structural modules 200, 400 are fully closed, the rear cover 20 and fixed fairing 30 work together to tightly close the rough opening, maintaining a seamless and aesthetically pleasing appearance.

FIG. 8 demonstrates the structural robustness and design flexibility of the adaptive system. The C-shaped frames 200*a*, 200*b*, 400*a*, 400*b* provide structural integrity, while the connection to the frame 12*c* of frame sections 12*a-d* ensures the forward and rear structural modules 200, 400 remain securely anchored during operation. The omission of the fixed and sliding ladder sections improves the visibility of the deployed structural components, making it clear how the modules pivot and interact with the framing structure.

When the stairway is retracted and closed the aperture of the rough opening in the ceiling is closed by the cover 20 supported by the forward and by the rear structural module and by the fixed forward fairing 30 supported by the supporting frame 12*c* of frame 10 of the stairway (FIG. 5). The role of the cover 20 and of the forward fairing 30 is to close the aperture of the rough opening in the ceiling when the stairway is retracted and closed.

With reference to FIGS. 1, 2, 3 the rear module 400 is mechanically attached to the cantilever arms 500 that are supported by the forward module 200 and extend beyond the aft end 209 (FIG. 4) of the forward structural module 200. The cantilever arms 500 have holes at preset positions for attaching the rear module either far away i.e., longest spacing from the forward module as shown on FIG. 1, or shortest spacing from the forward module as shown on FIG. 2 or to any preset intermediate spacing position as shown on FIG. 3. The typical rough opening length in a ceiling for installing a stairway, whether automatic or manual, for residential homes usually vary between 54" long minimum or 65" long maximum. One can easily understand the considerable benefit of this invention as the same forward and rear modules fully equipped with their respective systems are common to whatever Rough Opening length. This invention eliminates the need to manufacture a specific stairway supporting structure for each Rough Opening dimension. While typical RO length can vary, as mentioned earlier between 54" to 65", the invention can be adapted for shorter or longer RO length or any intermediate required value.

With reference to FIGS. 1, 2, 3 and 4 the forward module is composed of two frames 200*a*, 200*b* of preferably of C-shape cross section so that it can support on its upper end a forward portion of the stairway fixed step section 600 (FIG. 7) and on its lower end a forward portion of the cover 20 (FIG. 5) for partial closing of the Rough Opening in the ceiling when the stairway is fully retracted. A fitting 208 (FIG. 4) is mechanically attached to the forward end 210 of frames 200*a*, 200*b* of the forward module 200. The fittings 208, hence the forward module 200, are supported by two clevis type fittings 40 (FIGS. 5, 5*a*) mechanically attached to frame 12*c* of supporting frame 10 (FIGS. 5, 8). This provides pivotal capability to the forward module 200. The forward module 200 can reach two positions, the closed position (FIG. 5) and the opened position (FIG. 5*a*).

The forward module 200 holds the balancing arms mechanism that controls the value of the opening angle of the forward module. The balancing arms mechanism comprises two arms 201*a*, 201*c* (FIG. 4*a*). One end 201*e* of each arm 201*a*, 201*c* is fixedly attached to a rod 201*b*, 201*d*. Rods 201*b* and 201*d* (FIG. 4*a*) engage the bearings 206 that are fixedly attached to the walls 200*a*, 200*b* (FIGS. 4*a*, 4*b*) of the forward structure structural module. In addition, and as shown on FIG. 4*a*, rods 201*b*, 201*d* are connected together via a shaft coupler 204 so that when the coupler is in place, rods 201*b*, 201*d* form one single part. The other end 201*f* of arms 201*a*, 201*c* is pivotally connected to one end 201*g* of arms 202*a*, 202*b* (FIG. 4*a*) while their other end 201*h* is pivotally connected to frame 12*b*, 12*d* of fixed supporting frame (10) (FIG. 8). In this manner, as the forward structural module rotates from its closed position shown in FIG. 7 to its opened position (FIG. 8) the set of arms 201*a*, 202*a* pivots in unison with the opposite set of arms 201*c*, 202*b*.

In reference to FIGS. 4, 4*a*, 4*b* each rod 201*b*, 201*d* is fitted with a structural pin 203 that cooperates with angular limit fitting 205. When the adaptable structure is in its closed position (FIG. 7), the pin 203 is not in contact (FIG. 7) with the fitting 205 fixedly attached to each of the walls 200*a*, 200*b* of the forward structural module 200. As the stairway is commanded to its opened position, hence the forward module pivots from its closed position (FIGS. 5, 7) to its opened position (FIGS. 5*a*, 8) leading the pin 203 to abut on fitting 205 (FIGS. 4*a*, 4*b*, 8), hence stopping the rotation of the forward structural module 200 and also of the rear module 400 since both modules are mechanically attached together via cantilever arms 500.

With reference to FIG. 6 the rear module is composed of two frames 400*a*, 400*b* of preferably of C-shape cross section so it can support on its upper end a rear portion of the stairway fixed step section 600 (FIG. 7) and on its lower end a rear portion of the cover 20 for partially closing of the Rough Opening in the ceiling when the stairway is fully retracted. With reference to FIGS. 1, 2, 3 the rear module 400 is mechanically attached to cantilever arms 500 that are supported by the forward module 200 and extend beyond the aft end 209 (FIG. 4) of the forward module. The cantilever arms 500 have holes at preset positions for attaching the rear module either far away i.e., longest spacing from the forward module as shown on FIG. 1, or shortest spacing from the forward module as shown on FIG. 2 or to any preset intermediate spacing position as shown on FIG. 3. Since the rear module is mechanically attached to the forward module, it rotates in unison with the forward module when the stairway is controlled to extend or retract. Still in reference to FIG. 6, the rear module supports a pan 401 that is mechanically attached to the frames 400*a*, 400*b*. The pan 401 supports the motorized system 100 of the stairway and its electrical circuit for wireless control of the opening or closing of the forward and rear structural modules. No further description of the motorized system is provided as it is well described in U.S. Pat. No. 12,173,511.

With reference to FIGS. 4, 6 the forward and rear structural modules are preferably sheet metal aluminum or steel but also can be casted. All required holes for the forward and rear modules are drilled while the modules are in their sheet metal unfolded configuration, consequently, once the sheet metal structural modules are folded, all required holes are present; this significantly reduces the assembly time, hence the manufacturing cost of the stairway. Also, and because the spacing of the rear module to the forward module is adjustable, the same forward and rear modules, fully equipped with their respective systems, are used for whatever rough opening length practiced into the ceiling; this also contributes to significantly reduce the manufacturing cost of the stairway.

With reference to FIG. 5, frame 12*c* of the supporting frame 10 (FIG. 8) provides support to a fixed fairing 30. When the structural modules 200, 400 are closed (FIG. 5, 7) the panel 20 is also closed as it is attached the underneath of the structural modules 200, 400. As shown in FIG. 5, the fixed fairing 30 corporates with the panel 20 for finishing closing the aperture of the Rough Opening in the ceiling. When the stairway is controlled to reach its opened position (FIG. 5*a*), the forward edge 21 of the panel 20 rotates inside the fairing 30.

The supporting frame 10 is fixedly mounted to the elevated structure via the frame sections 12*a-d* using for example structural lag screws or any other structural nuts and bolts. In an embodiment, the supporting frame 10 provides pivotal capability to the forward module 200, hence to the rear module 400. The supporting frame 10 also supports a fixed fairing 30 that cooperates with the forward edge 21 of the panel 20 for the closed or opened positions of the adaptable structure.

The sliding sections, not shown, of the ladders are directly installed on top of the fixed ladder section 600 (FIG. 7) that is bridging the forward and rear structural modules. As the sliding sections and their operation are well depicted in U.S. Pat. No. 12,173,511, no further description is provided.

FIGS. 9*a* and 9*b* illustrate the stairway system 1001 in its fully extended and fully retracted configurations, respectively. These figures showcase the operation of the motorized system 100 in deploying and retracting the sliding ladder sections 700, 800, which extend from the fixed stairway section 600.

In FIG. 9*a*, the stairway system 1001 is shown in its fully deployed state, where the sliding ladder sections 700, 800 have extended outward from the fixed stairway section 600 to provide access to an elevated space. The rear module 400 is equipped with a pan or platform 401, which serves as the mounting base for the motorized system 100. This motorized system includes key components such as:

- A gearmotor 402 mounted on the rear structural module 400,
- Shafts 404, 404 that transmit rotational force,
- Reels 407, which are responsible for winding and unwinding the cables 403 that control the movement of the sliding ladder sections 700, 800.

As the motorized system 100 operates, it unwinds the cables 403, allowing the sliding ladder sections 700, 800 to extend outward, under gravity force, at a controlled speed. The fixed stairway section 600 provides a stable platform for these ladder sections, ensuring that the stairway remains securely attached to the adaptive supporting structure 1000 during operation.

FIG. 9*b* depicts the stairway system 1001 in its fully retracted state, where the sliding ladder sections 700, 800 are stowed onto the fixed stairway section 600. In this configuration, the motorized system 100 has engaged its gearmotor 402 to rewind the cables 403, causing the sliding ladder sections 700, 800 to retract and fold neatly onto the fixed stairway section 600. The pan or platform 401 continues to provide a stable base for the motorized system 100, ensuring that all moving components remain securely housed within the rear structural module 400. The reels 407 store the cables 403 in an organized manner, preventing tangling or misalignment during operation. The shafts 404, 404 assist in transmitting rotational force efficiently, ensuring smooth and controlled movement of the ladder sections.

In the fully retracted position, the stairway system 1001 is compact and does not obstruct the opening in the ceiling or elevated structure. The rear cover 20, which is attached to the forward structural module 200 and rear structural module 400, works in conjunction with the fixed fairing 30 to partially or fully close the rough opening when the stairway is not in use.

It will be appreciated that the various embodiments and aspects of the disclosure described previously are combinable according to any technically permissible combinations. For example, various aspects of the present disclosure may be used alone, in combination, or in a variety of arrangements not specifically described in the embodiments described in the foregoing and is therefore not limited in its application to the details and arrangement of components set forth in the foregoing description or illustrated in the drawings. For example, aspects described in one embodiment may be combined in any manner with aspects described in other embodiments. Having described above several aspects of at least one embodiment, it is to be appreciated various alterations, modifications, and improvements will readily occur to those skilled in the art. Such alterations, modifications, and improvements are intended to be object of this disclosure. Accordingly, the foregoing description and drawings are by way of example only.

The articles "a" and "an" may be employed in connection with various elements, components, compositions, processes or structures described herein. This is merely for convenience and to give a general sense of the compositions, processes or structures. Such a description includes "one or at least one" of the elements or components. Moreover, as used herein, the singular articles also include a description of a plurality of elements or components, unless it is apparent from a specific context that the plural is excluded.

As used herein in the specification and in the claims, the phrase "at least one", in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

Having described above several aspects of at least one embodiment, it is to be appreciated various alterations, modifications, and improvements will readily occur to those skilled in the art. Such alterations, modifications, and improvements are intended to be aspects of this disclosure. Accordingly, the foregoing description and drawings are by way of example only.

I claim:

1. A stairway system for accessing a space above or below an elevated structure, the stairway system comprising:

an adaptive supporting structure including a forward structural module configured to be pivotally mounted within an opening of the elevated structure, the forward structural module including a first end configured to be pivotally connected to a support structure of the elevated structure via a pivot axis, a second end extending away from the pivot axis, a mechanism configured to be attached to the elevated structure and configured to control a pivoting angle of the forward structural module;

a rear structural module positioned rearward of the forward structural module and mechanically connected thereto;

at least two cantilever arms extending from the second end of the forward structural module, at least one of the rear and forward structural modules being adjustably mounted to the cantilever arms at a selectable distance from another one of the at least one of the rear and forward structural modules;

a fixed stairway section mounted to and bridging the forward structural module and the rear structural module, the fixed stairway section having an upper surface for supporting at least one sliding stairway section;

a motorized system mounted on the rear structural module and operatively connected to the at least one sliding stairway section, the motorized system being configured to control the extension and retraction of the at least one sliding stairway section;

a cover attached to an underside of the forward structural module and the rear structural module;

wherein the at least one of the rear and forward structural modules mounted to the cantilever arms is secured to a selected one of a plurality of preset positions on the cantilever arms, thereby allowing the distance between the forward and rear structural modules to be selectively adjusted;

and wherein the forward structural module and the rear structural module are configured to pivot in unison about the pivot axis during deployment and retraction of the stairway system.

2. The stairway system of claim 1, wherein the mechanism includes balancing arms connected to one or more rods supported by bearings mounted on walls of the forward structural module.

3. The stairway system of claim 1, wherein the pivoting angle of the forward structural module is defined by a structural pin interacting with an angular limit fitting mounted on a wall of the forward structural module to restrict opening of the forward structural module to a maximum opening angle.

4. The stairway system of claim 3, wherein the structural pin is mounted on a rod mounted on the forward structural module, the structural pin adapted to rotate in unison with the rod so as to interact with said angular limit fitting.

5. The stairway system of claim 1, wherein the cantilever arms include preset holes for securing the rear structural module at a desired position using fasteners.

6. The stairway system of claim 1, wherein the cover is adapted to cooperate with a fixed fairing mounted on the elevated structure to at least partially close the opening when the stairway system is in a retracted position.

7. The stairway system of claim 6, wherein the forward edge of the cover is adapted to fit within the fixed fairing to create a sealed closure when the stairway system is in the retracted position.

8. The stairway system of claim 1, wherein the fixed stairway section is fastened to the forward structural module and the rear structural module through a plurality of fastening holes.

9. The stairway system of claim 1, wherein the motorized system includes a gearmotor, shafts, and at least one reel configured to wind and unwind a cable system that controls the movement of the at least one sliding stairway section.

10. The stairway system of claim 1, wherein the motorized system is configured to provide controlled extension and retraction of the at least one sliding stairway section at a predefined speed.

11. The stairway system of claim 1, wherein the rear structural module includes a platform that serves as a mounting base for the motorized system.

12. The stairway system of claim 1, wherein the at least one sliding stairway section is configured to extend outward in a telescoping manner from the fixed stairway section when the stairway system is deployed.

13. The stairway system of claim 1, wherein the motorized system is configured to operate via a wired control switch or a remote wireless control.

14. The stairway system of claim 1, wherein the pivot axis of the forward structural module is positioned near a front portion of the rough opening, enabling the stairway system to pivot outward smoothly during deployment, and the motorized system is mounted near a rear portion of the rear structural module such that the pivot axis and the motorized system are arranged on opposite ends of the adaptive supporting structure.

15. An adaptive supporting structure of a stairway system for accessing a space above or below an elevated structure, the adaptive supporting structure comprising:

a forward structural module configured to be pivotally mounted within an opening of the elevated structure, the forward structural module including a first end configured to be pivotally connected to a support structure of the elevated structure via a pivot axis, a second end extending away from the pivot axis, a mechanism configured to be attached to the elevated structure and configured to control a pivoting angle of the forward structural module;

a rear structural module positioned rearward of the forward structural module and mechanically connected thereto;

at least two cantilever arms extending from the second end of the forward structural module, at least one of the rear and forward structural modules being adjustably mounted to the cantilever arms at a selectable distance from another one of the at least one of the rear and forward structural modules;

a fixed stairway section mounted to and bridging the forward structural module and the rear structural module, the fixed stairway section having an upper surface for supporting at least one sliding stairway section;

a motorized system mounted on the rear structural module and operatively connected to the at least one sliding stairway section, the motorized system being configured to control the extension and retraction of the at least one sliding stairway section;

a cover attached to an underside of the forward structural module and the rear structural module;

wherein the at least one of the rear and forward structural modules mounted to the cantilever arms is secured to a selected one of a plurality of preset positions on the cantilever arms, thereby allowing the distance between the forward and rear structural modules to be selectively adjusted;

and wherein the forward structural module and rear structural module are configured to pivot in unison about the pivot axis during deployment and retraction of the stairway system.

16. The adaptive supporting structure of claim 15, wherein the mechanism includes balancing arms connected to one or more rods supported by bearings mounted on walls of the forward structural module.

17. The adaptive supporting structure of claim 15, wherein the pivoting angle of the forward structural module is defined by a structural pin interacting with an angular limit fitting mounted on a wall of the forward structural module to restrict opening of the forward structural module to a maximum opening angle.

18. The adaptive supporting structure of claim 17, wherein the structural pin is mounted on a rod mounted on the forward structural module, the structural pin adapted to rotate in unison with the rod so as to interact with said angular limit fitting.

19. The adaptive supporting structure of claim 15, wherein the cantilever arms include preset holes for securing the rear structural module at a desired position using fasteners.

20. The adaptive supporting structure of claim 15, wherein the cover is adapted to cooperate with a fixed fairing mounted on the elevated structure to at least partially close the opening when the stairway system is in a retracted position.

* * * * *